US010520233B2

(12) United States Patent
Watanabe et al.

(10) Patent No.: US 10,520,233 B2
(45) Date of Patent: Dec. 31, 2019

(54) AIR-CONDITIONING APPARATUS FOR A PLURALITY OF PARALLEL OUTDOOR UNITS

(71) Applicant: Mitsubishi Electric Corporation, Chiyoda-ku (JP)

(72) Inventors: Kazuya Watanabe, Chiyoda-ku (JP); Shinichi Wakamoto, Chiyoda-ku (JP); Naofumi Takenaka, Chiyoda-ku (JP); Naomichi Tamura, Chiyoda-ku (JP); Tadashi Ariyama, Chiyoda-ku (JP); Koji Yamashita, Chiyoda-ku (JP); Takeshi Hatomura, Chiyoda-ku (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 183 days.

(21) Appl. No.: 15/542,145

(22) PCT Filed: Jan. 13, 2015

(86) PCT No.: PCT/JP2015/050692

§ 371 (c)(1),
(2) Date: Jul. 7, 2017

(87) PCT Pub. No.: WO2016/113850

PCT Pub. Date: Jul. 21, 2016

(65) Prior Publication Data

US 2018/0266743 A1 Sep. 20, 2018

(51) Int. Cl.
*F25B 47/02* (2006.01)
*F24F 11/42* (2018.01)
(Continued)

(52) U.S. Cl.
CPC ..... *F25B 47/025* (2013.01); *F24F 11/42* (2018.01); *F24F 11/89* (2018.01); *F25B 47/02* (2013.01);
(Continued)

(58) Field of Classification Search
USPC ..... 165/156
See application file for complete search history.

(56) References Cited

U.S. PATENT DOCUMENTS 3,638,444 A * 2/1972 Lindahl ..... F25B 47/025 62/151
5,315,836 A * 5/1994 Ressler ..... F25B 47/022 62/277
(Continued)

FOREIGN PATENT DOCUMENTS

EP 2930450 A1 10/2015
JP 64-041782 A 2/1989
(Continued)

OTHER PUBLICATIONS

International Search Report dated Apr. 14, 2015 in PCT/JP2015/050692, filed Jan. 13, 2015.
(Continued)

*Primary Examiner* — Henry T Crenshaw
(74) *Attorney, Agent, or Firm* — Oblon, McClelland, Maier & Neustadt, L.L.P.

(57) ABSTRACT

An air-conditioning apparatus is capable of efficiently performing defrosting operation without suspending a heating operation of an indoor unit. The air-conditioning apparatus includes a main circuit sequentially connecting, via a pipe, a compressor, indoor heat exchangers, first flow control devices, and a plurality of parallel heat exchangers connected in parallel to each other to allow refrigerant to circulate, first defrost pipes branching a part of the refrigerant discharged from the compressor and causing the part of the refrigerant to flow into one of the plurality of parallel heat exchangers to be defrosted, an interface heat exchanger located between the plurality of parallel heat exchangers, a first bypass pipe branching a part of the refrigerant discharged from the compressor and causing the part of the refrigerant to flow into the interface heat exchanger, and a second bypass pipe causing the part of the refrigerant
(Continued)

flowing out of the interface heat exchanger to flow into the main circuit.

14 Claims, 10 Drawing Sheets

(51) Int. Cl.
*F24F 11/89* (2018.01)
*F24F 140/12* (2018.01)
*F24F 110/12* (2018.01)

(52) U.S. Cl.
CPC ..... *F24F 2110/12* (2018.01); *F24F 2140/12* (2018.01); *F25B 2347/021* (2013.01)

(56) References Cited

U.S. PATENT DOCUMENTS

2004/0134205 A1* 7/2004 Park ..... F25B 13/00 62/151
2006/0144060 A1* 7/2006 Birgen ..... F25B 13/00 62/151
2010/0170270 A1* 7/2010 Jang ..... F25B 13/00 62/81
2011/0041541 A1* 2/2011 Yoon ..... F24F 1/32 62/324.5
2013/0098092 A1* 4/2013 Wakamoto ..... F25B 1/10 62/278
2014/0165628 A1 6/2014 Tamura et al.
2014/0311172 A1* 10/2014 Iwasaki ..... F24F 1/06 62/151
2015/0292739 A1 10/2015 Takenaka et al.
2015/0292789 A1* 10/2015 Takenaka ..... F25B 13/00 62/140
2018/0266743 A1* 9/2018 Watanabe ..... F25B 47/02

FOREIGN PATENT DOCUMENTS

JP 2008-64381 A 3/2008
JP 2009-281607 A 12/2009
JP 2011-075207 A 4/2011
JP 2014-119165 A 6/2014
WO 2014/083650 A1 6/2014
WO 2014/083867 A1 6/2014

OTHER PUBLICATIONS

Extended European Search Report dated Aug. 6, 2018 in Patent Application No. 15877805.0, 10 pages.
Japanese Office Action dated Oct. 31, 2017 in Japanese Patent Application No. 2016-569154 (with unedited computer generated English translation).
Office Action and Search Report dated Mar. 5, 2019 in the corresponding Chinese Patent Application No. 201580072548.X with English Translation and English Translation of Category of Cited Documents.
Chinese Office Action issued in Chinese Patent Application No. 201580072548.X dated Nov. 6, 2019 (w/ English translation).
2nd Chinese office action.

* cited by examiner

FIG. 3

| VALVE NO. | COOLING OPERATION | HEATING OPERATION | | |
|---|---|---|---|---|
| | | NORMAL HEATING OPERATION | CONTINUOUS HEATING OPERATION | |
| | | | 5-1: EVAPORATOR 5-2: DEFROSTED | 5-1: DEFROSTED 5-2: EVAPORATOR |
| 2 | OFF | ON | ON | ON |
| 4b, 4c | REFRIGERANT AT OUTLET OF INDOOR UNIT SUPERHEATED | REFRIGERANT AT OUTLET OF INDOOR UNIT SUBCOOLED | REFRIGERANT AT OUTLET OF INDOOR UNIT SUBCOOLED | REFRIGERANT AT OUTLET OF INDOOR UNIT SUBCOOLED |
| 7-1 | FULLY OPEN | FULLY OPEN | FULLY OPEN | PRESSURE OF HEAT EXCHANGER TO BE DEFROSTED |
| 7-2 | FULLY OPEN | FULLY OPEN | PRESSURE OF HEAT EXCHANGER TO BE DEFROSTED | FULLY OPEN |
| 8-1 | ON | ON | ON | OFF |
| 8-2 | ON | ON | OFF | ON |
| 9-1 | OFF | OFF | OFF | ON |
| 9-2 | OFF | OFF | ON | OFF |
| 10 | CLOSED | CLOSED | FIXED OPENING DEGREE | FIXED OPENING DEGREE |
| 12 | FULLY OPEN | FULLY OPEN | PRESSURE OF INTERFACE HEAT EXCHANGER | PRESSURE OF INTERFACE HEAT EXCHANGER |

AIR-CONDITIONING APPARATUS FOR A PLURALITY OF PARALLEL OUTDOOR UNITS

TECHNICAL FIELD

The present invention relates to an air-conditioning apparatus.

BACKGROUND ART

From the viewpoint of protection of the global environment, these days an increasing number of boiler-based heating apparatuses that use fossil fuel for the heating operation have come to be substituted with heat pump-based air-conditioning apparatuses that utilize air as heat source, even in cold districts.

The heat pump-based air-conditioning apparatus is capable of performing the heating operation more efficiently because, in addition to electrical inputs to a compressor, heat from the air can be utilized.

On the other hand, when the outdoor temperature drops, frost is formed on an outdoor heat exchanger serving as evaporator, and hence a defrosting operation has to be performed to melt the frost formed on the outdoor heat exchanger.

To defrost, the refrigeration cycle may be reversed. However, in this case, the heating of the room is suspended during the defrosting operation, and consequently comfort is impaired.

Thus, as one of methods to perform the heating operation even during the defrosting operation, a technique has been proposed that includes dividing the outdoor heat exchanger to cause a part of the divided outdoor heat exchangers to act as evaporator, and receiving heat from air in the evaporator thereby performing the heating operation while the other heat exchanger is performing the defrosting operation (see, for example, Patent Literature 1 and Patent Literature 2).

With the technique according to Patent Literature 1, the outdoor heat exchanger is divided into a plurality of parallel heat exchangers, and a part of high-temperature refrigerant discharged from the compressor is alternately supplied to each of the parallel heat exchangers to thereby alternately defrost the parallel heat exchangers. Thus, the heating operation can be continued without reversing the refrigeration cycle.

With the technique according to Patent Literature 2, the outdoor heat exchanger is divided into two parallel heat exchangers, namely an upper outdoor heat exchanger and a lower outdoor heat exchanger. When one of the heat exchangers is defrosted, a main circuit opening and closing mechanism, on the side of the inlet of the heat exchanger to be defrosted in the heating operation, is closed, and a bypass on-off valve of a bypass circuit, through which the refrigerant from the discharge pipe of the compressor flows to the inlet of the heat exchanger, is opened. Consequently, a part of the high-temperature refrigerant discharged from the compressor is made to flow into the heat exchanger to be defrosted, so that the defrosting and the heating can be performed at the same time. When one of the heat exchangers has been defrosted, the defrosting of the other heat exchanger is started. In addition, a hot pipe is interposed between an indoor heat exchanger and a depressurizing device, under the upper outdoor heat exchanger. The refrigerant flowing out of the outlet of the indoor heat exchanger is made to flow into the hot pipe when the defrosting and the heating are performed at the same time, to enhance the defrosting effect in the boundary between the upper outdoor heat exchanger and the lower outdoor heat exchanger, thus to prevent formation of root ice.

CITATION LIST

Patent Literature

Patent Literature 1: International Publication No. 2014/083867

Patent Literature 2: Japanese Unexamined Patent Application Publication No. 2009-281607

SUMMARY OF INVENTION

Technical Problem

In the air-conditioning apparatus according to Patent Literature 1, when the plurality of parallel heat exchangers are located next to each other, the heat leaks in the vicinity of the boundary, from the heat exchanger to be defrosted to the heat exchanger acting as evaporator, and consequently the frost is not easily melted and a sufficient defrosting effect is unable to be attained. As result, a long time is required to defrost and the room heating capacity declines during the defrosting operation, impairing comfort in the indoor environment. Further, water generated after the defrosting freezes and turns into root ice, and consequently the heat transfer area of the heat exchanger is reduced and the heating capacity declines, impairing comfort in the indoor environment.

The air-conditioning apparatus according to Patent Literature 2 includes the hot pipe to enhance the defrosting effect in the boundary; however, for this purpose, the refrigerant that already released heat in the indoor heat exchanger is utilized. Thus, the refrigerant that can be used has only a small quantity of heat and hence the defrosting effect may be unable to be enhanced in the boundary, for example, when the outdoor temperature is very low or when the heat is released between the indoor heat exchanger and the hot pipe, and resultantly root ice may be formed.

The present invention has been accomplished in view of the foregoing problem, and provides an air-conditioning apparatus capable of efficiently performing the defrosting operation without suspending the heating operation of the indoor unit.

Solution to Problem

An air-conditioning apparatus of an embodiment of the present invention includes a main circuit sequentially connecting, via a pipe, a compressor, an indoor heat exchanger, a first flow control device, and a plurality of parallel heat exchangers connected in parallel to each other to allow refrigerant to circulate, a defrost pipe that branches a part of the refrigerant discharged from the compressor and causes the part of the refrigerant to flow into one of the plurality of parallel heat exchangers, an interface heat exchanger located between the plurality of parallel heat exchangers, a first bypass pipe that branches a part of the refrigerant discharged from the compressor and causes the part of the refrigerant to flow into the interface heat exchanger, and a second bypass pipe that causes the part of the refrigerant flowing out of the interface heat exchanger to flow into the main circuit.

Advantageous Effects of Invention

The air-conditioning apparatus according to an embodiment of the present invention includes the interface heat exchanger, with which a defrosting operation can be efficiently performed without suspending a heating operation of an indoor unit.

BRIEF DESCRIPTION OF DRAWINGS

FIG. 3 is a table showing control settings for refrigerant communications and opening degrees of valves in different operation modes of the air-conditioning apparatus according to Embodiment 1 of the present invention.

DESCRIPTION OF EMBODIMENTS

Hereinafter, Embodiments of the present invention will be described with reference to the drawings.

In all the drawings, components of the same reference signs represent the same or corresponding ones, which applies to the entirety of the description.

In addition, the shapes of the components expressed in the description are merely exemplary, and do not limit the present invention.

Embodiment 1

Figure 1:
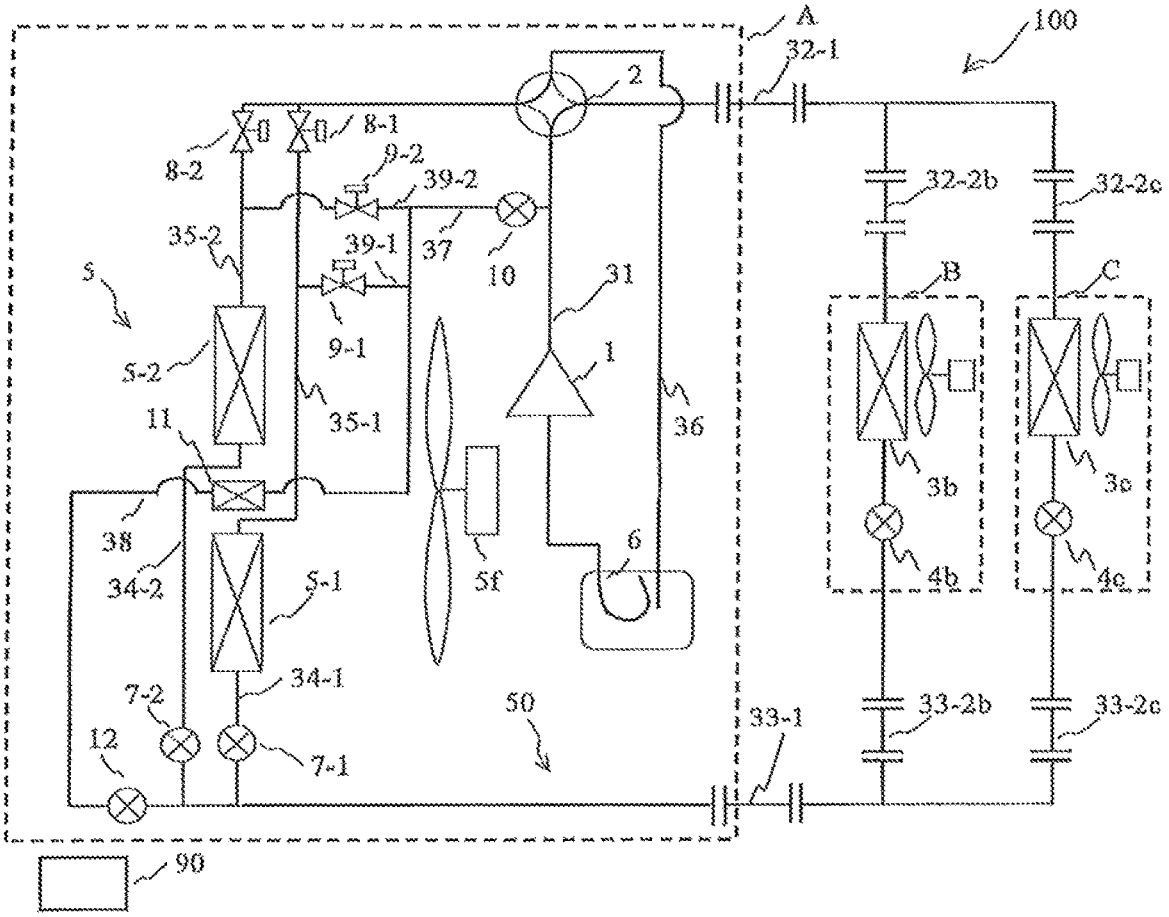
FIG. 1 is a schematic diagram showing a circuit configuration of an air-conditioning apparatus according to Embodiment 1 of the present invention.

FIG. 1 is a schematic diagram showing a circuit configuration of an air-conditioning apparatus 100 according to Embodiment 1 of the present invention.

The air-conditioning apparatus 100 includes an outdoor unit A and a plurality of indoor units B and C connected in parallel to each other, and the outdoor unit A and the indoor units B and C are connected to each other via first extension pipes 32-1, 32-2*b*, and 32-2*c* and second extension pipes 33-1, 33-2*b*, and 33-2*c*.

The air-conditioning apparatus 100 also includes a controller 90, which controls a cooling operation and a heating operation (normal heating operation, heating and defrosting operation) of the indoor units B and C.

In the air-conditioning apparatus 100, a fluorocarbon refrigerant or a HFO refrigerant may be employed. Examples of the fluorocarbon refrigerant include R32 refrigerant, R125, and R134a, which are HFC-based refrigerants, and also R410A, R407c, and R404A, which are mixed refrigerants of the first cited refrigerants. Examples of the HFO refrigerant include HFO-1234yf, HFO-1234ze (E), and HFO-1234ze (Z). Alternatively, a $CO_2$ refrigerant, a HC refrigerant (e.g., propane, isobutane refrigerant), an ammonia refrigerant, and various mixed refrigerants such as a mixture of R32 and HFO-1234yf, which are applicable to a steam-compression heat pump, may be employed.

Although Embodiment 1 refers to the case where two indoor units B and C are connected to a single outdoor unit A, the number of indoor units may be one, or three or more, and two or more outdoor units may be connected in parallel. Further, the refrigerant circuit may be configured to enable a cooling and heating mixed operation, in which each of the indoor units can select either of the cooling operation and the heating operation, by connecting three extension pipes in parallel, or providing a switching valve on the side of the indoor units.

The configuration of the refrigerant circuit in the air-conditioning apparatus 100 will be described below.

The refrigerant circuit in the air-conditioning apparatus 100 includes a main circuit 50 sequentially connecting, via a pipe, a compressor 1, a cooling-heating switching device 2 for switching the cooling operation and the heating operation, indoor heat exchangers 3*b* and 3*c*, first flow control devices 4*b* and 4*c* that can be opened and closed, and an outdoor heat exchanger 5.

The main circuit 50 also includes an accumulator 6, which, although, is not mandatory and may be omitted.

The outdoor heat exchanger 5 will be subsequently described with reference to FIG. 2.

The cooling-heating switching device 2 is connected between a discharge pipe 31 and a suction pipe 36 of the compressor 1, and may be, for example, a four-way valve that switches the flow direction of the refrigerant.

In the heating operation, the cooling-heating switching device 2 is switched as indicated by solid lines in FIG. 1, and in the cooling operation, the cooling-heating switching device 2 is switched as indicated by broken lines in FIG. 1.

The description below refers to the case where the outdoor heat exchanger 5 is divided into two parallel heat exchangers 5-1 and 5-2 and an interface heat exchanger 11.

An outdoor fan 5*f* supplies outdoor air to the parallel heat exchangers 5-1 and 5-2 and the interface heat exchanger 11.

Although the outdoor fan 5*f* may be provided for each of the parallel heat exchangers 5-1 and 5-2 and the interface heat exchanger 11, only one outdoor fan 5*f* may be provided as in FIG. 1. In the case where only one outdoor fan 5*f* is provided, the center of the outdoor fan 5*f* is located close to the interface heat exchanger 11, because the interface heat exchanger 11 is located between the parallel heat exchangers 5-1 and 5-2.

First connection pipes 34-1 and 34-2 are respectively connected to the parallel heat exchangers 5-1 and 5-2 on the side connected to the first flow control devices 4*b* and 4*c*.

The first connection pipe 34-1 and 34-2 respectively include second flow control devices 7-1 and 7-2, and are connected in parallel to a main pipe extending from the second flow control devices 7-1 and 7-2.

The opening degrees of the second flow control device 7-1 and 7-2 are variable in accordance with an instruction from the controller 90. The second flow control device 7-1 and 7-2 may be, for example, constituted of an electronically controlled expansion valve.

Second connection pipes 35-1 and 35-2 are respectively connected to the parallel heat exchangers 5-1 and 5-2 on the side connected to the compressor 1, and to the compressor 1 via first solenoid valves 8-1 and 8-2.

The refrigerant circuit further includes a first bypass pipe 37 that branches a part of high-temperature and high-pressure refrigerant discharged from the compressor 1 and supplies the branched refrigerant to the interface heat exchanger 11, a second bypass pipe 38 connecting the interface heat exchanger 11 and the main circuit 50, and first defrost pipes 39-1 and 39-2 that supply a part of the high-temperature and high-pressure refrigerant discharged from the compressor 1 to the parallel heat exchangers 5-1 and 5-2, respectively.

The first bypass pipe 37 has one end connected to the discharge pipe 31, and the other end connected to the interface heat exchanger 11. The second bypass pipe 38 has one end connected to the interface heat exchanger 11, and the other end connected to the main pipe extending from the second flow control devices 7-1 and 7-2. The first defrost pipes 39-1 and 39-2 each have one end connected to the first bypass pipe 37, and the other end connected to a corresponding one of the second connection pipes 35-1 and 35-2.

The first bypass pipe 37 includes a first expansion device 10 that depressurizes a part of the high-temperature and high-pressure refrigerant discharged from the compressor 1 to a medium pressure. The second bypass pipe 38 includes a second expansion device 12. The first defrost pipes 39-1 and 39-2 respectively include second solenoid valves 9-1 and 9-2.

The solenoid valves 8-1, 8-2, 9-1, and 9-2 are capable of switching the flow path, and hence may each be constituted of a four-way valve, a three-way valve, a two-way valve, or a similar device.

In the case where the required defrosting capacity, in other words the flow rate of the refrigerant for defrosting is determined, capillary tubes may be employed as the first expansion device 10. Alternatively, the first expansion device 10 may be located at each one of positions beyond the branching point between the first defrost pipes 39-1 and 39-2, and the second solenoid valves 9-1 and 9-2 may be made smaller in size to reduce the pressure to a medium pressure at a predetermined flow rate of the refrigerant for defrosting. Further, the first expansion device 10 may be located at each one of positions beyond the branching point between the first defrost pipes 39-1 and 39-2, and the second solenoid valves 9-1 and 9-2 may each be substituted with a flow control device.

The first expansion device 10 corresponds to the first expansion device in the present invention. The second expansion device 12 corresponds to the second expansion device and the first opening and closing device in the present invention. The first bypass pipe 37 and the first defrost pipes 39-1 and 39-2 correspond to the first defrost pipe in the present invention. The first defrost pipes 39-1 and 39-2 correspond to the third bypass pipe in the present invention. The first expansion device 10 and the second solenoid valves 9-1 and 9-2 correspond to the connection switching device in the present invention.

Figure 2:
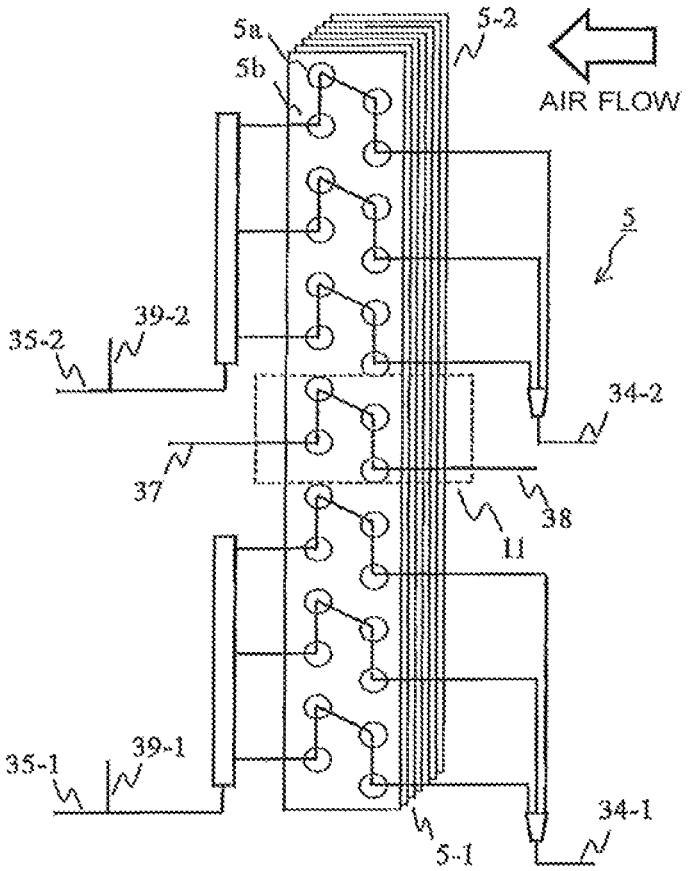
FIG. 2 is a schematic diagram showing a structure of an outdoor heat exchanger in the air-conditioning apparatus according to Embodiment 1 of the present invention.

FIG. 2 is a schematic diagram showing a structure of the outdoor heat exchanger 5 in the air-conditioning apparatus 100 according to Embodiment 1 of the present invention.

As shown in FIG. 2, the outdoor heat exchanger 5 is, for example, a fin and tube heat exchanger including a plurality of heat transfer pipes 5*a* and a plurality of fins 5*b*. The outdoor heat exchanger 5 is divided into a plurality of parallel heat exchangers.

The heat transfer pipes 5*a* are provided for the refrigerant to flow inside the heat transfer pipes 5*a*, and aligned in a step direction orthogonal to the airflow direction, and in a column direction parallel to the airflow direction, both in a plurality of numbers.

The fins 5*b* are aligned parallel to each other with a space between the fins 5*b*, to allow air to pass in the airflow direction.

The parallel heat exchangers 5-1 and 5-2 are formed by dividing the outdoor heat exchanger 5 in a vertical direction inside the casing of the outdoor unit A. The parallel heat exchanger 5-1 is located on the lower side, and the parallel heat exchanger 5-2 is located on the upper side.

Between the parallel heat exchangers 5-1 and 5-2, the interface heat exchanger 11 having a predetermined width is located.

For the parallel heat exchangers 5-1 and 5-2 and the interface heat exchanger 11, each of the fins 5*b* may be continuous as illustrated in FIG. 2, or divided. In addition, the number of parallel heat exchangers in the outdoor heat exchanger 5 is not limited to two and may be a desired number, but the interface heat exchanger is located between each pair of the parallel heat exchangers.

The first bypass pipe 37 and the second bypass pipe 38 are preferably arranged to allow the refrigerant flowing through each of the parallel heat exchangers 5-1 and 5-2 and the interface heat exchanger 11 to flow in the same direction, in the cooling operation and the normal heating operation. This is because, in the case where the refrigerant flowing through each of the parallel heat exchangers 5-1 and 5-2 and the interface heat exchanger 11 in opposite directions, the refrigerant flowing through the parallel heat exchangers 5-1 and 5-2 and the refrigerant flowing through the interface heat exchanger 11 exchange heat between each other, degrading the efficiency of heat exchange with air. In other words, the interface heat exchanger 11 functions as a part of an integral heat exchanger in collaboration with the parallel heat exchangers 5-1 and 5-2 in the cooling operation and the normal heating operation, to efficiently exchange heat.

Operations performed by the air-conditioning apparatus 100 in different operation modes will be described below.

The air-conditioning apparatus 100 is configured to perform a plurality of operation modes, which are the cooling operation and the heating operation.

Further, the heating operation includes the normal heating operation in which both of the parallel heat exchangers 5-1 and 5-2 constituting the outdoor heat exchanger 5 act as evaporator, and the heating and defrosting operation (also called continuous heating operation) in which the defrosting operation is performed while the heating operation is continued.

In the heating and defrosting operation, the parallel heat exchanger 5-1 and the parallel heat exchanger 5-2 are alternately defrosted, while the heating operation is continued. More specifically, one of the parallel heat exchangers is defrosted while the other parallel heat exchanger is acting as evaporator to continue the heating operation. When defrosting of the one parallel heat exchanger is finished, the one parallel heat exchanger in turn acts as evaporator to perform the heating operation, and the other parallel heat exchanger is defrosted.

FIG. 3 is a table showing control settings for refrigerant communications and opening degrees of valves in different operation modes of the air-conditioning apparatus 100 shown in FIG. 1. As shown in FIG. 3, ON of the cooling-heating switching device 2 corresponds to the direction of the solid lines and OFF corresponds to the direction of the broken lines, in the four-way valve shown in FIG. 1. ON of the solenoid valves 8-1, 8-2, 9-1, and 9-2 corresponds to the state where the solenoid valve is open to allow the refrigerant to flow, and OFF corresponds to the state where the solenoid valve is closed.

[Cooling Operation]

Figure 4:
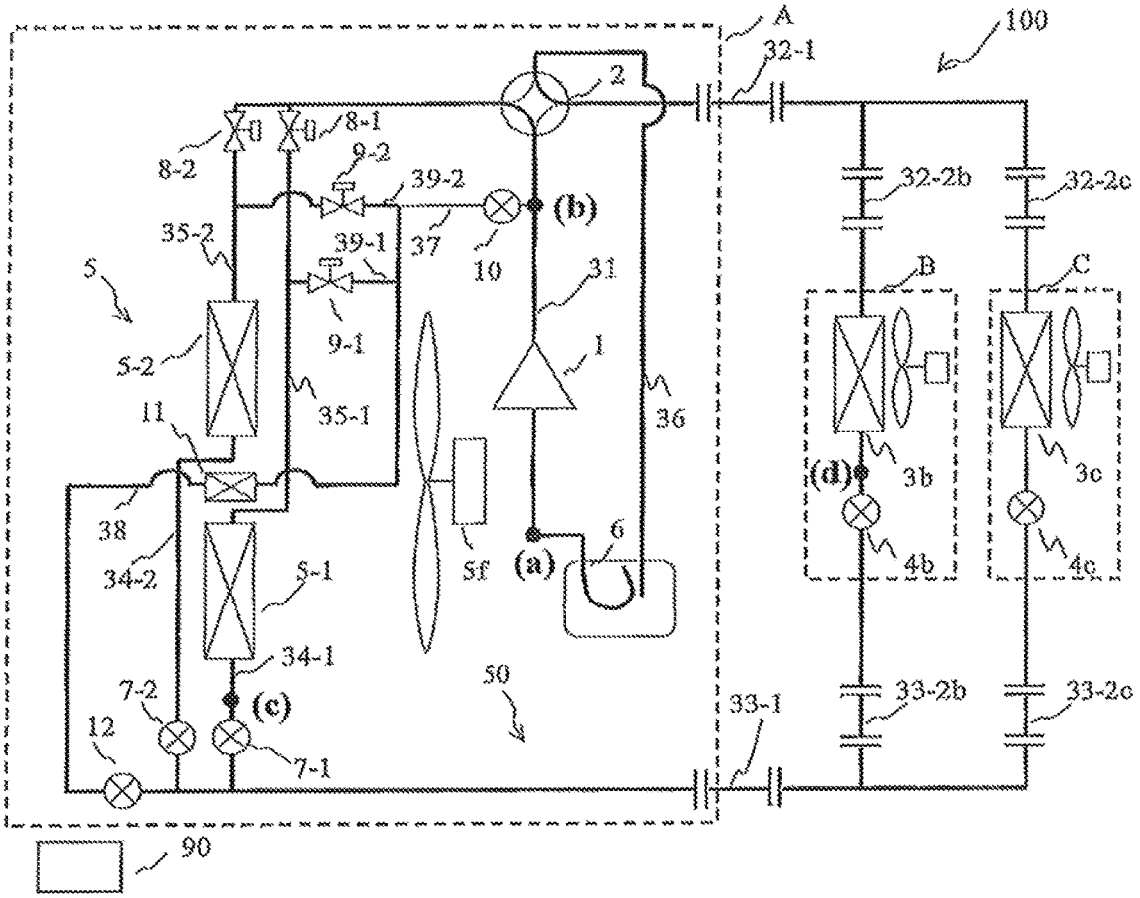
FIG. 4 is a schematic diagram showing a flow of refrigerant in a cooling operation of the air-conditioning apparatus according to Embodiment 1 of the present invention.

FIG. 4 is a schematic diagram showing a flow of the refrigerant in the cooling operation of the air-conditioning apparatus 100 according to Embodiment 1 of the present invention. In FIG. 4, bold lines represent the portions where the refrigerant flows, and fine lines represent the portions where the refrigerant does not flow, in the cooling operation.

Figure 5:
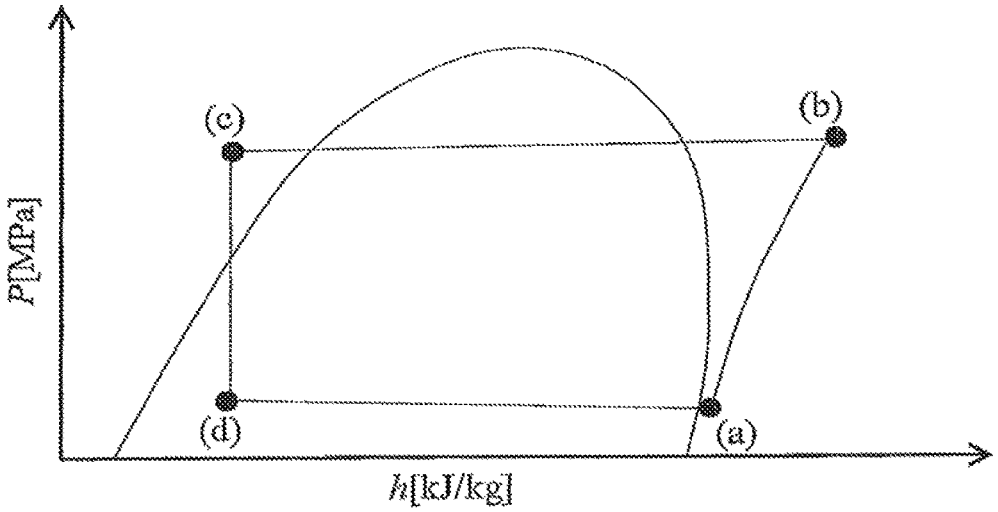
FIG. 5 is a P-h diagram representing the cooling operation of the air-conditioning apparatus according to Embodiment 1 of the present invention.

FIG. 5 is a P-h diagram representing the cooling operation of the air-conditioning apparatus 100 according to Embodiment 1 of the present invention. Points (a) to (d) in FIG. 5 represent the states of the refrigerant at the points of the same codes in FIG. 4.

With reference to FIG. 3, FIG. 4, and FIG. 5, the cooling operation of the air-conditioning apparatus 100 will be described.

When the compressor 1 is activated, low-temperature and low-pressure gas refrigerant is compressed by the compressor 1 and discharged in the form of the high-temperature and high-pressure gas refrigerant.

In the refrigerant compression process in the compressor 1, the refrigerant is compressed to be heated more than in the case where the refrigerant is adiabatically compressed as represented by an isentropic line, by an amount corresponding to the adiabatic efficiency of the compressor 1. The compression process corresponds to the line drawn between the point (a) and the point (b) in FIG. 5.

The high-temperature and high-pressure gas refrigerant discharged from the compressor 1 passes through the cooling-heating switching device 2 and is branched into two flows, and the branched refrigerant passes through the first solenoid valves 8-1 and 8-2. The refrigerant passing through the first solenoid valve 8-1 is again branched into two flows, one of which flows into the parallel heat exchanger 5-1 through the second connection pipe 35-1 and the other of which flows into the second solenoid valve 9-1 through the first defrost pipe 39-1. The refrigerant passing through the first solenoid valve 8-2 is again branched into two flows, one of which flows into the parallel heat exchanger 5-2 through the second connection pipe 35-2 and the other of which flows into the second solenoid valve 9-2 through the first defrost pipe 39-2. The refrigerant each passing through the second solenoid valves 9-1 and 9-2 is merged and flows into the interface heat exchanger 11.

One of the second solenoid valves 9-1 and 9-2 may be closed to cause the refrigerant to flow only through the opened valve and then flow into the interface heat exchanger 11.

The refrigerant flowing into the parallel heat exchangers 5-1 and 5-2 and the interface heat exchanger 11 is cooled while the refrigerant is heating the outdoor air, thereby turning into medium-temperature and high-pressure liquid refrigerant. The change of the refrigerant state in the parallel heat exchangers 5-1 and 5-2 and the interface heat exchanger 11 can be expressed by a slightly inclined, generally horizontal straight line drawn between the point (b) and the point (c) in FIG. 5, when pressure loss in the outdoor heat exchanger 5 is taken into account.

Thus, in the cooling operation without the defrosting operation, the interface heat exchanger 11 can be utilized similarly to the parallel heat exchangers 5-1 and 5-2, which are also the outdoor heat exchangers, and consequently high efficiency can be attained. More specifically, in the cooling operation in which the first expansion device 10 is closed, the second solenoid valves 9-1 and 9-2 are opened, and all of the parallel heat exchangers 5-1 and 5-2 and the interface heat exchanger 11 act as condenser, the flow path in the first bypass pipe 37 is closed to cause the refrigerant to flow through the first defrost pipes 39-1 and 39-2 and the interface heat exchanger 11. Consequently, the area of the condensers is increased and hence the amount of heat radiated from the outdoor air is increased, thereby improving cooling capacity.

In the case where, for example, the indoor units B and C have low operation capacity, one of the first solenoid valves 8-1 and 8-2, and the second solenoid valves 9-1 and 9-2 may be closed to prevent the refrigerant from flowing through the interface heat exchanger 11 and one of the parallel heat exchangers 5-1 and 5-2. Such an arrangement resultantly reduces the heat transfer area of the outdoor heat exchangers 5, thereby stabilizing the operation of the refrigeration cycle.

The medium-temperature and high-pressure liquid refrigerant flowing out of the parallel heat exchangers 5-1 and 5-2 flows into the first connection pipes 34-1 and 34-2 and is merged after passing through the second flow control devices 7-1 and 7-2, which are fully opened. The medium-temperature and high-pressure liquid refrigerant flowing out of the interface heat exchanger 11 flows into the second bypass pipe 38 and is merged after passing through the second expansion device 12, which is fully opened. The merged refrigerant passes through the second extension pipes 33-1, 33-2*b*, and 33-2*c* and flows into the first flow control devices 4*b* and 4*c* to be throttled, thus to be expanded and depressurized, thereby turning into low-temperature and low-pressure two-phase gas-liquid refrigerant. The state of the refrigerant in the first flow control devices 4*b* and 4*c* changes under constant enthalpy. The change of the refrigerant state in this process can be expressed by a vertical line drawn between the point (c) and the point (d) in FIG. 5.

The low-temperature and low-pressure two-phase gas-liquid refrigerant flowing out of the first flow control devices 4*b* and 4*c* flows into the indoor heat exchangers 3*b* and 3*c*. The refrigerant flowing into the indoor heat exchangers 3*b* and 3*c* is heated while the refrigerant is cooling the indoor air, and turns into low-temperature and low-pressure gas refrigerant. The first flow control devices 4*b* and 4*c* are controlled to make the degree of superheat of the low-temperature and low-pressure gas refrigerant to be approximately 2 K to 5 K.

The change of the refrigerant state in the indoor heat exchangers 3*b* and 3*c* can be expressed by a slightly inclined, generally horizontal straight line drawn between the point (d) and the point (a) in FIG. 5, when pressure loss is taken into account. The low-temperature and low-pressure gas refrigerant flowing out of the indoor heat exchangers 3*b* and 3*c* flows into the compressor 1 through the first extension pipes 32-2*b*, 32-2*c*, and 32-1, the cooling-heating switching device 2, and the accumulator 6, to be compressed in the compressor 1.

[Normal Heating Operation]

Figure 6:
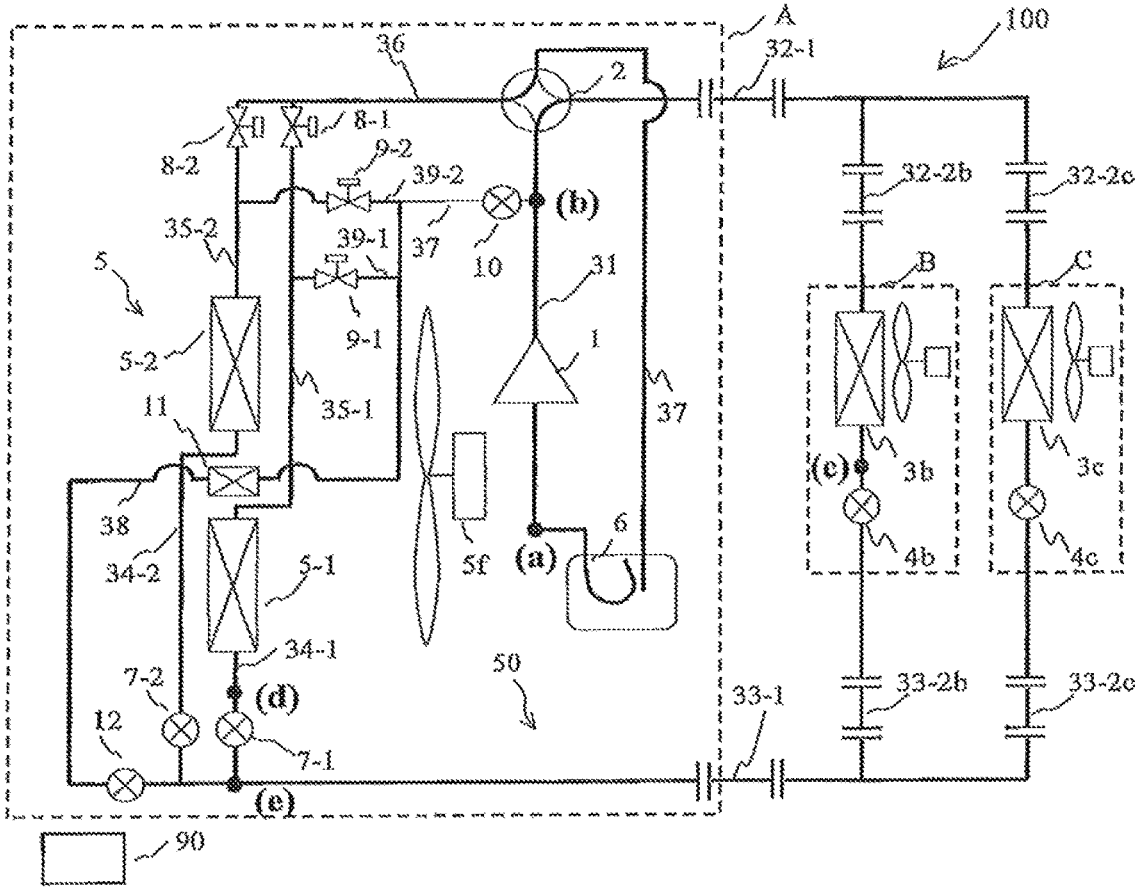
FIG. 6 is a schematic diagram showing a flow of refrigerant in a normal heating operation of the air-conditioning apparatus according to Embodiment 1 of the present invention.

FIG. 6 is a schematic diagram showing a flow of the refrigerant in the normal heating operation of the air-conditioning apparatus 100 according to Embodiment 1 of the present invention. In FIG. 6, bold lines represent the portions where the refrigerant flows, and fine lines represent the portions where the refrigerant does not flow, in the normal heating operation.

Figure 7:
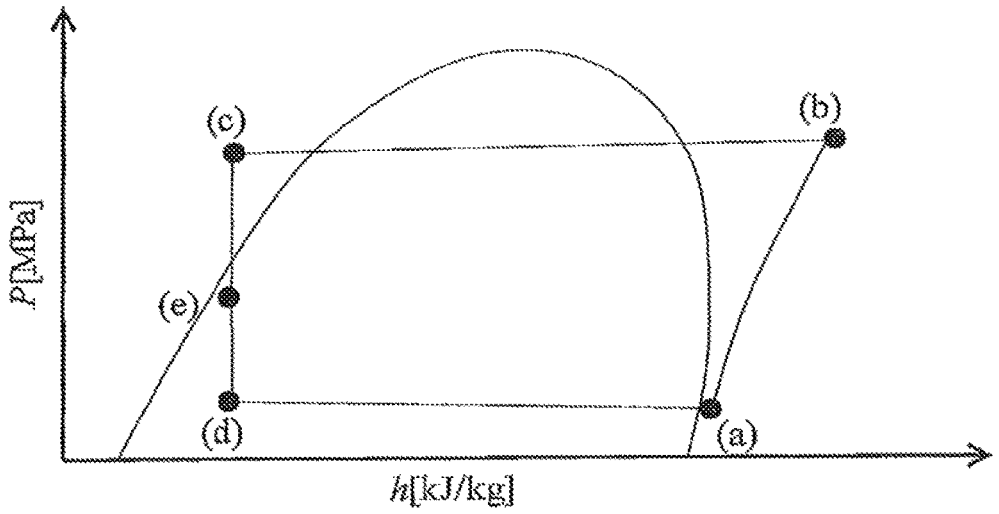
FIG. 7 is a P-h diagram representing the normal heating operation of the air-conditioning apparatus according to Embodiment 1 of the present invention.

FIG. 7 is a P-h diagram representing the normal heating operation of the air-conditioning apparatus 100 according to Embodiment 1 of the present invention. Points (a) to (e) in FIG. 7 represent the states of the refrigerant at the points of the same codes in FIG. 6.

With reference to FIG. 3, FIG. 6, and FIG. 7, the normal heating operation of the air-conditioning apparatus 100 will be described.

When the compressor 1 is activated, low-temperature and low-pressure gas refrigerant is compressed by the compressor 1, and discharged in the form of the high-temperature and high-pressure gas refrigerant. The refrigerant compression process of the compressor 1 corresponds to the line drawn between the point (a) and the point (b) in FIG. 7.

The high-temperature and high-pressure gas refrigerant discharged from the compressor 1 flows out of the outdoor unit A after passing through the cooling-heating switching device 2. The high-temperature and high-pressure gas refrigerant flowing out of the outdoor unit A flows into the indoor heat exchangers 3*b* and 3*c* of the indoor units B and C, through the first extension pipes 32-1, 32-2*b*, and 32-2*c*.

The refrigerant flowing into the indoor heat exchangers 3*b* and 3*c* is cooled while heating the indoor air, thereby turning into medium-temperature and high-pressure liquid refrigerant. The change of the refrigerant state in the indoor heat exchangers 3*b* and 3*c* can be expressed by a slightly inclined, generally horizontal straight line drawn between the point (b) and the point (c) in FIG. 7.

The medium-temperature and high-pressure liquid refrigerant flowing out of the indoor heat exchangers 3*b* and 3*c* flows into the first flow control devices 4*b* and 4*c* to be throttled, thus to be expanded and depressurized, thereby turning into medium-pressure two-phase gas-liquid refrigerant.

The change of the refrigerant state in this process can be expressed by a vertical line drawn between the point (c) and the point (e) in FIG. 7.

The first flow control devices 4*b* and 4*c* are controlled to make the degree of subcooling of the medium-temperature and high-pressure liquid refrigerant to be approximately 5 K to 20 K.

The medium-pressure two-phase gas-liquid refrigerant flowing out of the first flow control devices 4*b* and 4*c* returns to the outdoor unit A through the second extension pipes 33-2*b*, 33-2*c*, and 33-1. The refrigerant returning to the outdoor unit A flows into the first connection pipes 34-1 and 34-2 and the second bypass pipe 38.

The refrigerant flowing into the first connection pipes 34-1 and 34-2 is throttled, thus to be expanded and depressurized by the second flow control devices 7-1 and 7-2, thereby turning into low-pressure two-phase gas-liquid refrigerant. The refrigerant flowing into the second bypass pipe 38 is throttled, thus to be expanded and depressurized by the second expansion device 12, thereby turning into low-pressure two-phase gas-liquid refrigerant. The change of the refrigerant state in this process can be expressed by a line drawn between the point (e) and the point (d) in FIG. 7.

The second flow control devices 7-1 and 7-2 and the second expansion device 12 are set to a fixed opening degree, for example, fully opened, or controlled to make the saturation temperature at the medium pressure in the second extension pipe 33-1 or similar pipes to be approximately 0 degrees Celsius to 20 degrees Celsius.

The refrigerant flowing out of the second flow control devices 7-1 and 7-2 flows into the parallel heat exchangers 5-1 and 5-2 and is heated while the refrigerant is cooling the outdoor air, thereby turning into low-temperature and low-pressure gas refrigerant. The refrigerant flowing out of the second expansion device 12 flows into the interface heat exchanger 11 and is heated while the refrigerant is cooling the outdoor air, thereby turning into low-temperature and low-pressure gas refrigerant. The change of the refrigerant state in the parallel heat exchangers 5-1 and 5-2 and the interface heat exchanger 11 can be expressed by a slightly inclined, generally horizontal straight line drawn between the point (d) and the point (a) in FIG. 7.

Thus, in the normal heating operation without the defrosting operation, the interface heat exchanger 11 can be utilized similarly to the parallel heat exchangers 5-1 and 5-2, which are also the outdoor heat exchangers, and consequently high efficiency can be attained. More specifically, in the normal heating operation in which the first expansion device 10 is closed, the second solenoid valves 9-1 and 9-2 are opened, and all of the parallel heat exchangers 5-1 and 5-2 and the interface heat exchanger 11 act as evaporator, the flow path in the first bypass pipe 37 is closed to cause the refrigerant to flow through the first defrost pipes 39-1 and 39-2 and the interface heat exchanger 11. Consequently, the area of the evaporators is increased and hence the amount of heat removed from the outdoor air is increased, thereby improving heating capacity.

The low-temperature and low-pressure gas refrigerant flowing out of the parallel heat exchangers 5-1 and 5-2 flows into the second connection pipe 35-1 and 35-2. The low-temperature and low-pressure gas refrigerant flowing out of the interface heat exchanger 11 is branched into two flows, one of which flows into the second connection pipe 35-1 through the second solenoid valve 9-1, and the other of which flows into the second connection pipe 35-2 through the second solenoid valve 9-2. The low-temperature and low-pressure gas refrigerant flowing into the second connection pipes 35-1 and 35-2 is merged after passing through the first solenoid valves 8-1 and 8-2, and the merged refrigerant flows into the compressor 1 through the cooling-heating switching device 2, and the accumulator 6, to be compressed.

One of the second solenoid valves 9-1 and 9-2 may be closed to cause the refrigerant to flow only through the opened valve, and the refrigerant flowing out of the interface heat exchanger 11 flows into one of the second connection pipes 35-1 and 35-2.

[Heating and Defrosting Operation (Continuous Heating Operation)]

The heating and defrosting operation is performed when frost is formed on the outdoor heat exchanger 5 during the normal heating operation.

The decision of the frost formation may be made, for example, when a saturation temperature converted from the suction pressure of the compressor 1 has significantly dropped compared with a predetermined outdoor temperature. Alternatively, the decision of the frost formation may be made, for example, when a difference between the outdoor temperature and the evaporating temperature exceeds a predetermined value and the difference has been higher than the predetermined value for a period longer than a predetermined length of time.

The air-conditioning apparatus 100 according to Embodiment 1 is configured to, in the heating and defrosting operation, defrost the parallel heat exchanger 5-2 and cause the parallel heat exchanger 5-1 to act as evaporator thereby continuing the heating operation. Conversely, the air-conditioning apparatus 100 is also configured to cause the parallel heat exchanger 5-2 to act as evaporator to continue the heating operation, while defrosting the parallel heat exchanger 5-1.

First, the operation performed for defrosting the parallel heat exchanger 5-2 and causing the parallel heat exchanger 5-1 to act as evaporator thereby continuing the heating operation will be described.

Figure 8:
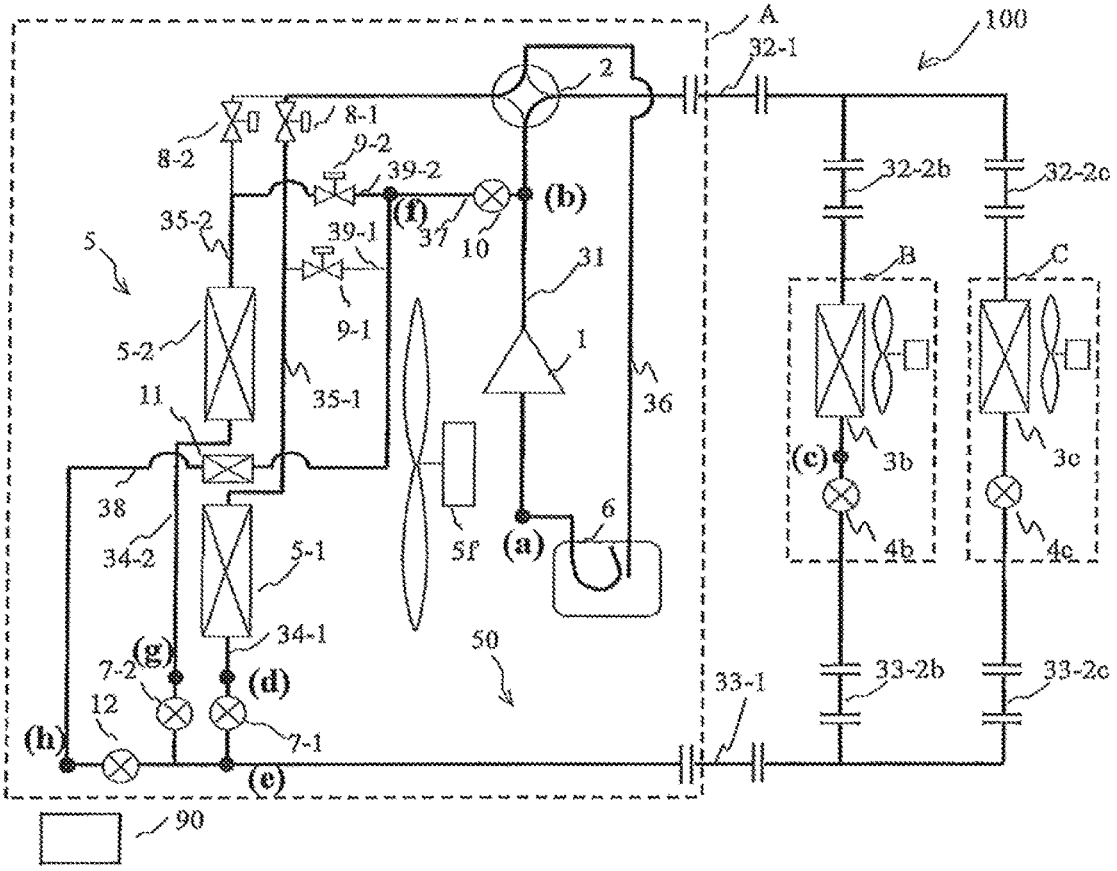
FIG. 8 is a schematic diagram showing a flow of refrigerant in a heating and defrosting operation performed for defrosting a parallel heat exchanger of the air-conditioning apparatus according to Embodiment 1 of the present invention.

FIG. 8 is a schematic diagram showing a flow of the refrigerant in the heating and defrosting operation for defrosting the parallel heat exchanger 5-2 of the air-conditioning apparatus 100 according to Embodiment 1 of the present invention. In FIG. 8, bold lines represent the portions where the refrigerant flows, and fine lines represent the portions where the refrigerant does not flow, in the heating and defrosting operation.

Figure 9:
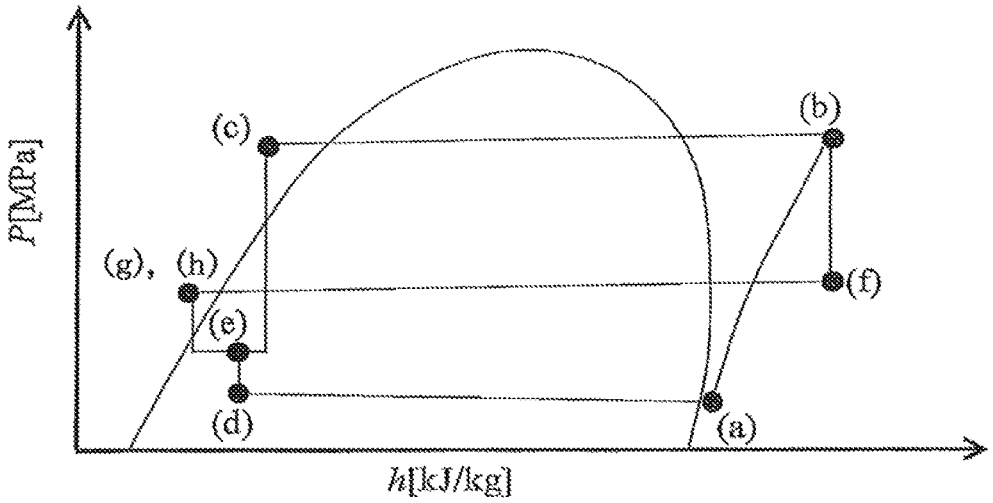
FIG. 9 is a P-h diagram representing the heating and defrosting operation of the air-conditioning apparatus according to Embodiment 1 of the present invention.

FIG. 9 is a P-h diagram representing the heating and defrosting operation of the air-conditioning apparatus 100 according to Embodiment 1 of the present invention. Points (a) to (h) in FIG. 9 represent the states of the refrigerant at the points of the same codes in FIG. 8.

With reference to FIG. 3, FIG. 8, and FIG. 9, the heating and defrosting operation of the air-conditioning apparatus 100 will be described.

When the controller 90 determines, during the normal heating operation, that the defrosting operation has to be performed to remove the formed frost, the controller 90 closes the first solenoid valve 8-2 corresponding to the parallel heat exchanger 5-2 to be defrosted. The controller 90 also opens the second solenoid valve 9-2 and sets the first expansion device 10 to a predetermined opening degree. The first solenoid valve 8-1 corresponding to the parallel heat exchanger 5-1 acting as evaporator is caused to be opened, and the second solenoid valve 9-1 is caused to be closed.

Under such settings, the defrosting circuit sequentially connecting the compressor 1, the first expansion device 10, the second solenoid valve 9-2, the parallel heat exchanger 5-2, and the second flow control device 7-2 is opened to start the heating and defrosting operation. In addition, the bypass circuit sequentially connecting the compressor 1, the first expansion device 10, the interface heat exchanger 11, and the second expansion device 12 is opened to enhance the defrosting effect in the boundary, thereby preventing formation of root ice.

When the heating and defrosting operation is started, a part of the high-temperature and high-pressure gas refrigerant discharged from the compressor 1 flows into the first bypass pipe 37, and is depressurized to a medium pressure in the first expansion device 10. The change of the refrigerant state in this process can be expressed by a line drawn between the point (b) and the point (f) in FIG. 9.

The refrigerant depressurized to the medium pressure (point (f)) is branched into two flows, one of which flows into the parallel heat exchanger 5-2 through the second solenoid valve 9-2, and the other of which flows into the interface heat exchanger 11. The refrigerant flowing into the parallel heat exchanger 5-2 is cooled by exchanging heat with the frost stuck to the parallel heat exchanger 5-2. The refrigerant flowing into the interface heat exchanger 11 heats parts of the fins **5*b* located between the parallel heat exchanger 5-1 and the parallel heat exchanger 5-2, to thereby prevent leakage of heat, at the boundary, from the parallel heat exchanger 5-2, which is being defrosted, to the parallel heat exchanger 5-1** acting as evaporator, thus preventing degradation of the defrosting effect.

In the case where the interface heat exchanger 11 is not located and hence the boundary between the parallel heat exchanger 5-1 and the parallel heat exchanger 5-2 is difficult to be defrosted, the defrosting operation may be finished when most of the frost on the parallel heat exchanger 5-2 is melted but the frost still remains in the boundary. In addition, the water produced through the defrosting operation for the parallel heat exchanger 5-2, which is located on the upper side, drops onto the parallel heat exchanger 5-1 located on the lower side and acting as evaporator. When the water produced through the defrosting operation is cold and reaches the parallel heat exchanger 5-1, which is also cold, such water is cooled to 0 degrees Celsius and lower and frozen immediately and a large amount of ice may be formed in the vicinity of the boundary. When the defrosting operation is finished, the parallel heat exchanger 5-2 starts to act as evaporator. Subsequently, the remaining frost containing moisture is cooled and turns into root ice. Further, as frost is formed while the heat exchanger 5-2 is acting as evaporator, the frost formed during the immediately preceding operation as evaporator is added to the root ice formed from the frost that remained after the previous defrosting operation, before the next defrosting operation is performed. Consequently, an additional amount of frost may remain unmelted, so that the root ice further grows. Air is unable to pass through the portion where the root ice is formed, and consequently the heat transfer performance of the heat exchanger is degraded, thereby degrading heating capacity.

In contrast, according to Embodiment 1 of the present invention, the high-temperature and high-pressure gas refrigerant discharged from the compressor 1 is made to flow into the parallel heat exchanger 5-2, and consequently the frost stuck to the parallel heat exchanger 5-2 can be melted. In addition, allowing the high-temperature and high-pressure gas refrigerant discharged from the compressor 1 to flow into the interface heat exchanger 11 enhances the defrosting effect in the boundary, thereby preventing the formation of root ice in the boundary, where the root ice is easily formed by freezing the water produced through the defrosting operation. Further, the temperature of the water produced through the defrosting operation is raised by the interface heat exchanger 11, and consequently the water can be prevented from being frozen and reach the lowermost portion of the parallel heat exchanger 5-1. The change of the refrigerant state in this process can be expressed by a line drawn between the point (f) and the points (g) and (h) in FIG. 9.

In addition, the refrigerant utilized for the defrosting operation has a saturation temperature of approximately 0 degrees Celsius to 10 degrees Celsius, which is equal to or higher than the temperature of the frost (0 degrees Celsius). The pressure of the refrigerant that flows into the interface heat exchanger 11 to be utilized for the defrosting operation is adjusted to a medium pressure corresponding to the saturation temperature of 0 degrees Celsius to 10 degrees Celsius, by controlling the first expansion device 10 and the second expansion device 12. Thus, the condensation latent heat of the refrigerant can be utilized for the defrosting operation, and also the heating capacity of the heat exchangers as a whole can be made uniform, in collaboration with the parallel heat exchanger 5-2.

The refrigerant utilized for the defrosting operation and flowing out of the parallel heat exchanger 5-2 passes through the second flow control device 7-2 and reaches the main circuit 50 to be merged. The refrigerant flowing out of the interface heat exchanger 11 passes through the second expansion device 12 and reaches the main circuit 50 to be merged. The merged refrigerant passes through the second flow control device 7-1 and flows into the parallel heat exchanger 5-1 acting as evaporator to be evaporated.

As described above, in the heating and defrosting operation, the second bypass pipe 38 is connected to allow the refrigerant flowing out of the interface heat exchanger 11 to flow into the main circuit 50 on the upstream side of the parallel heat exchanger 5-1, which is not the object of the defrosting operation. Consequently, the condensed refrigerant is caused to flow into the parallel heat exchanger 5-1 acting as evaporator to increase the amount of heat removed from the outdoor air in the parallel heat exchanger 5-1 acting as evaporator, thereby improving the heating capacity.

An example of the operation of the second flow control devices 7-1 and 7-2, the first expansion device 10, and the second expansion device 12 in the heating and defrosting operation will be described below.

During the heating and defrosting operation, the controller 90 controls the opening degree of the second flow control device 7-2 to make the saturation temperature converted from the pressure of the parallel heat exchanger 5-2 to be defrosted to be approximately 0 degrees Celsius to 10 degrees Celsius, and also controls the opening degree of the second expansion device 12 to make the saturation temperature converted from the pressure of the interface heat exchanger 11 to be approximately 0 degrees Celsius to 10 degrees Celsius. The opening degree of the second flow control device 7-1 is set to fully open, to produce a pressure difference between the upstream side and the downstream side of the second flow control device 7-2 and the second expansion device 12, thereby improving the controllability. Further, the difference between the discharge pressure of the compressor 1 and the pressure of the parallel heat exchanger 5-2 to be defrosted or the interface heat exchanger 11 does not remarkably fluctuate during the heating and defrosting operation, and consequently the opening degree of the first expansion device 10 is fixed in accordance with a predetermined flow rate required for the defrosting operation.

A part of the heat emitted from the refrigerant utilized for the defrosting operation, other than a part of the heat transferred to the frost stuck to the parallel heat exchanger 5-2, may be released to the outdoor air. To solve this problem, the controller 90 may control the first expansion device 10, the second expansion device 12, and the second flow control device 7-2, to increase the flow rate of the refrigerant for the defrosting operation as the outdoor temperature drops. Such an arrangement makes the amount of heat transferred to the frost to be constant and the time required for the defrosting to be constant, irrespective of the outdoor temperature. In this case, the first expansion device 10 is controlled, during the defrosting operation, to adjust the flow rate of the refrigerant flowing into the interface heat exchanger 11 depending on the outdoor temperature. Consequently, the flow rate of the refrigerant for the defrosting operation is controlled to be a suitable flow rate, and as the refrigerant flow for the heating can thus be secured, the heating capacity can be maintained at a high level.

The controller 90 may have a threshold of the outdoor temperature, and close the second expansion device 12 when the outdoor temperature is equal to or higher than a certain temperature (e.g., 0 degrees Celsius), to block the flow of the refrigerant in the bypass circuit sequentially connecting the compressor 1, the first expansion device 10, the interface heat exchanger 11, and the second expansion device 12. When the outdoor temperature is higher than 0 degrees Celsius, which is the melting point of the frost, the defrosting is promoted because the heat of the air also melts the frost. Further, the presence of the interface heat exchanger 11 having a predetermined width creates a distance between the parallel heat exchanger 5-2, which is being defrosted, and the parallel heat exchanger 5-1 acting as evaporator, and hence heat leakage is reduced compared with the case where the parallel heat exchanger 5-1 and the parallel heat exchanger 5-2 are directly next to each other. Consequently, a sufficient defrosting effect can be attained even in the boundary. Blocking the flow of the refrigerant in the bypass circuit and allowing the refrigerant supposed to flow into the interface heat exchanger 11 to flow into the indoor heat exchangers 3*b* and 3*c* improves the heating capacity, thereby improving the comfort in the indoor environment.

The operation for defrosting the parallel heat exchanger 5-1 and causing the parallel heat exchanger 5-2 to act as evaporator thereby continuing the heating operation will be described below.

Figure 10:
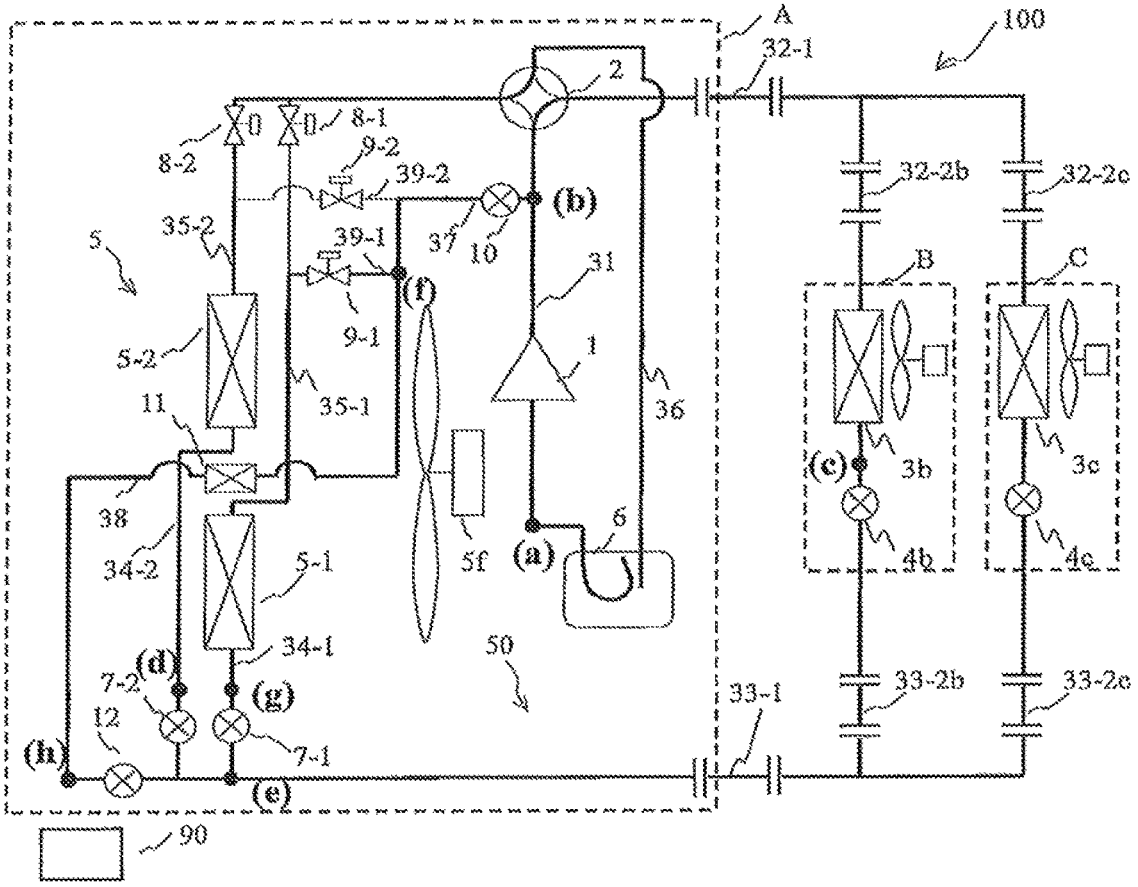
FIG. 10 is a schematic diagram showing a flow of refrigerant in the heating and defrosting operation performed for defrosting another parallel heat exchanger of the air-conditioning apparatus according to Embodiment 1 of the present invention.

FIG. 10 is a schematic diagram showing a flow of the refrigerant in the heating and defrosting operation for defrosting the parallel heat exchanger 5-1 of the air-conditioning apparatus 100 according to Embodiment 1 of the present invention. In FIG. 10, bold lines represent the portions where the refrigerant flows, and fine lines represent the portions where the refrigerant does not flow, in the heating and defrosting operation.

The states of the refrigerant at points (a) to (h) in FIG. 10 correspond to the points of the same codes in FIG. 9.

With reference to FIG. 3, FIG. 9, and FIG. 10, the heating and defrosting operation of the air-conditioning apparatus 100 will be described.

When the heating and defrosting operation for defrosting the parallel heat exchanger 5-1 is to be performed, the controller 90 closes the first solenoid valve 8-1 corresponding to the parallel heat exchanger 5-1 to be defrosted. The controller 90 also opens the second solenoid valve 9-1 and sets the first expansion device 10 to a predetermined opening degree. The first solenoid valve 8-2 corresponding to the parallel heat exchanger 5-2 acting as evaporator is caused to be opened, and the second solenoid valve 9-2 is caused to be closed.

Under such settings, the defrosting circuit sequentially connecting the compressor 1, the first expansion device 10, the second solenoid valve 9-1, the parallel heat exchanger 5-1, and the second flow control device 7-1 is opened to start the heating and defrosting operation. In addition, the bypass circuit sequentially connecting the compressor 1, the first expansion device 10, the interface heat exchanger 11, and the second expansion device 12 is opened to enhance the defrosting effect in the boundary, thereby preventing formation of root ice.

When the heating and defrosting operation is started, a part of the high-temperature and high-pressure gas refrigerant discharged from the compressor 1 flows into the first bypass pipe 37, and is depressurized to a medium pressure in the first expansion device 10. The change of the refrigerant state in this process can be expressed by the line drawn between the point (b) and the point (f) in FIG. 9.

The refrigerant depressurized to the medium pressure (point (f)) is branched into two flows, one of which flows into the parallel heat exchanger 5-1 through the second solenoid valve 9-1, and the other of which flows into the interface heat exchanger 11. The refrigerant flowing into the parallel heat exchanger 5-1 is cooled by exchanging heat with the frost stuck to the parallel heat exchanger 5-1. The refrigerant flowing into the interface heat exchanger 11 heats parts of the fins 5*b* located between the parallel heat exchanger 5-1 and the parallel heat exchanger 5-2, to thereby prevent leakage of heat from the parallel heat exchanger 5-1, which is being defrosted, to the parallel heat exchanger 5-2 acting as evaporator, thus preventing degradation of the defrosting effect in the boundary and the formation of root ice from the frost remaining unmelted.

As described above, the high-temperature and high-pressure gas refrigerant discharged from the compressor 1 is made to flow into the parallel heat exchanger 5-1, and consequently the frost stuck to the parallel heat exchanger 5-1 can be melted. In addition, allowing the high-temperature and high-pressure gas refrigerant discharged from the compressor 1 to flow into the interface heat exchanger 11 enhances the defrosting effect in the boundary, thereby preventing freezing of the water produced through the defrosting operation (formation of root ice) in the boundary, where the root ice is easily formed by freezing the water produced through the defrosting operation. The change of the refrigerant state in this process can be expressed by the line drawn between the point (f) and the points (g) and (h) in FIG. 9.

In addition, the refrigerant utilized for the defrosting operation has a saturation temperature of approximately 0 degrees Celsius to 10 degrees Celsius, which is equal to or higher than the temperature of the frost (0 degrees Celsius). The pressure of the refrigerant that flows into the interface heat exchanger 11 to be utilized for the defrosting operation is adjusted to a medium pressure corresponding to the saturation temperature of 0 degrees Celsius to 10 degrees Celsius, by controlling the first expansion device 10 and the second expansion device 12. Thus, the condensation latent heat of the refrigerant can be utilized for the defrosting operation, and also the heating capacity of the heat exchangers as a whole can be made uniform, in collaboration with the parallel heat exchanger 5-1.

The refrigerant utilized for the defrosting operation and flowing out of the parallel heat exchanger 5-1 passes through the second flow control device 7-1 and reaches the main circuit 50 to be merged. The refrigerant flowing out of the interface heat exchanger 11 passes through the second expansion device 12 and reaches the main circuit 50 to be merged. The merged refrigerant passes through the second flow control device 7-2 and flows into the parallel heat exchanger 5-2 acting as evaporator to be evaporated.

As described above, in the heating and defrosting operation, the second bypass pipe 38 is connected to allow the refrigerant flowing out of the interface heat exchanger 11 to flow into the main circuit 50 on the upstream side of the parallel heat exchanger 5-2, which is not the object of the defrosting operation. Consequently, the condensed refrigerant is caused to flow into the parallel heat exchanger 5-2 acting as evaporator to increase the amount of heat removed from the outdoor air in the parallel heat exchanger 5-2 acting as evaporator, thereby improving the heating capacity.

An example of the operation of the second flow control devices 7-1 and 7-2, the first expansion device 10, and the second expansion device 12 in the heating and defrosting operation will be described below.

During the heating and defrosting operation, the controller 90 controls the opening degree of the second flow control device 7-1 to make the saturation temperature converted from the pressure of the parallel heat exchanger 5-1 to be defrosted to be approximately 0 degrees Celsius to 10 degrees Celsius, and also controls the opening degree of the second expansion device 12 to make the saturation temperature converted from the pressure of the interface heat exchanger 11 to be approximately 0 degrees Celsius to 10 degrees Celsius. The opening degree of the second flow control device 7-2 is set to fully open, to produce a pressure difference between the upstream side and the downstream side of the second flow control device 7-1 and the second expansion device 12, thereby improving the controllability. Further, the difference between the discharge pressure of the compressor 1 and the pressure of the parallel heat exchanger 5-1 to be defrosted or the interface heat exchanger 11 does not remarkably fluctuate during the heating and defrosting operation, and consequently the opening degree of the first expansion device 10 is fixed in accordance with a predetermined flow rate required for the defrosting operation.

A part of the heat emitted from the refrigerant utilized for the defrosting operation, other than a part of the heat transferred to the frost stuck to the parallel heat exchanger 5-1, may be released to the outdoor air. To solve this problem, the controller 90 may control the first expansion device 10, the second expansion device 12, and the second flow control device 7-1, to increase the flow rate of the refrigerant for the defrosting operation as the outdoor temperature drops. Such an arrangement makes the amount of heat transferred to the frost to be constant and the time required for the defrosting to be constant, irrespective of the outdoor temperature. In this case, the first expansion device 10 is controlled, during the defrosting operation, to adjust the flow rate of the refrigerant flowing into the interface heat exchanger 11 depending on the outdoor temperature. Consequently, the flow rate of the refrigerant for the defrosting operation is controlled to be a suitable flow rate, and as the refrigerant flow for the heating can thus be secured, the heating capacity can be maintained at a high level.

The controller 90 may close the second expansion device 12 when the outdoor temperature is higher than 0 degrees Celsius, to block the flow of the refrigerant in the bypass circuit sequentially connecting the compressor 1, the first expansion device 10, the interface heat exchanger 11, and the second expansion device 12. When the outdoor temperature is higher than 0 degrees Celsius, the root ice is barely formed in the boundary because the outdoor air also melts the frost and the ice. Consequently, allowing the refrigerant to flow into the indoor heat exchangers 3*b* and 3*c* improves the heating capacity, thereby improving the comfort in the indoor environment.

Further, the controller 90 may close the second expansion device 12 to block the flow of the refrigerant in the bypass circuit sequentially connecting the compressor 1, the first expansion device 10, the interface heat exchanger 11, and the second expansion device 12, during the defrosting operation for the parallel heat exchanger 5-1 located on the lower side of the interface heat exchanger 11. When the parallel heat exchanger 5-1 on the lower side is defrosted, the water produced from the melted frost is barely frozen in the boundary, and hence the root ice is barely formed. Consequently, allowing the refrigerant to flow into the indoor heat exchangers 3*b* and 3*c* improves the heating capacity, thereby improving the comfort in the indoor environment.

Performing the heating and defrosting operation as described above enables the parallel heat exchangers 5-1 and 5-2 to be defrosted and continue the heating operation.

In Embodiment 1, the first bypass pipe 37 branches a part of the refrigerant discharged from the compressor 1 and causes the refrigerant to flow into the interface heat exchanger 11, and the second bypass pipe 38 causes the refrigerant flowing out of the interface heat exchanger 11 to flow into the main circuit 50, irrespective of which of the parallel heat exchangers 5-1 and 5-2 is to be defrosted in the heating and defrosting operation.

Thus, as the refrigerant for defrosting is made to flow through the interface heat exchanger 11 irrespective of which of the parallel heat exchangers 5-1 and 5-2 is to be defrosted, the boundary each between the heat exchanger 5-1 to be defrosted and the other region of the outdoor heat exchanger 5 not to be defrosted and the heat exchanger 5-2 to be defrosted and the other region of the outdoor heat exchanger 5 not to be defrosted is not fixed, because the boundary is shifted by a distance corresponding to the predetermined width of the interface heat exchanger 11, when the parallel heat exchanger to be defrosted is switched. Consequently, the boundary in the previous defrosting operation is located in the region to be defrosted in the next defrosting operation. As result, as the boundary of the region to be defrosted is shifted, the water produced in the boundary from the melted frost is barely frozen in the boundary, and hence root ice is barely formed. In addition, in the region where the interface heat exchanger 11 is located, the frost is encouraged to turn into water because of the defrosting operation, and also the water thus produced can smoothly flow down without being disturbed by the frost.

In the case where the parallel heat exchanger 5-2 on the upper side is defrosted first and then the parallel heat exchanger 5-1 on the lower side is to be defrosted, the water produced from the defrosting operation for the parallel heat exchanger 5-2 is frozen owing to the frost stuck to the parallel heat exchanger 5-1, which is not defrosted yet. Consequently, the controller 90 preferably defrosts the lower parallel heat exchanger 5-1 first, and then defrosts the upper parallel heat exchanger 5-2.

Further, as the refrigerant for defrosting is made to flow through the interface heat exchanger 11 irrespective of which of the parallel heat exchangers 5-1 and 5-2 is to be defrosted, the boundary between the heat exchangers 5-1 and 5-2 to be defrosted is not fixed, because the boundary is shifted by a distance corresponding to the predetermined width of the interface heat exchanger 11, when the parallel heat exchanger to be defrosted is switched. Consequently, the upper boundary of the defrosting operation for the lower parallel heat exchanger 5-1 is located in the region to be defrosted in the next defrosting operation for the upper parallel heat exchanger 5-2. As result, as the boundary of the region to be defrosted is shifted, the water produced in the boundary from the melted frost is barely frozen in the boundary, and hence root ice is barely formed. In addition, in the region where the interface heat exchanger 11 is located, the frost is encouraged to turn into water because of the defrosting operation, and also the water thus produced can smoothly flow down without being disturbed by the frost.

In the case where the lower parallel heat exchanger 5-1 is defrosted first, the upper parallel heat exchanger 5-2 acts as evaporator while the frost is stuck to the parallel heat exchanger 5-2, and hence the heat exchange performance with air is degraded compared with the case where the parallel heat exchanger 5-1 is acting as evaporator, degrading heating capacity. Thus, to give higher capacity to the parallel heat exchanger 5-2 than the parallel heat exchanger 5-1, a value calculated by an expression of (flow rate of air applied to parallel heat exchanger at maximum fan speed ($m^3/s$))×(surface area of parallel heat exchanger ($m^3$)) in the parallel heat exchanger 5-2 on the upper side is larger than a value calculated by the expression of (flow rate of air applied to parallel heat exchanger at maximum fan speed ($m^3/s$)) (surface area of parallel heat exchanger ($m^3$)) in the parallel heat exchanger 5-1 on the lower side. With such an arrangement, even when the parallel heat exchanger 5-2 on the upper side acts as evaporator, the parallel heat exchanger 5-2 can exhibit higher heating performance as evaporator despite the frost stuck to the parallel heat exchanger 5-2, and consequently the degradation in heating capacity can be prevented.

The controller 90 may change the threshold of the saturation temperature used for deciding whether frost has been formed, the duration of the normal operation, or other factors, depending on the outdoor temperature. More specifically, the duration of the operation may be shortened as the outdoor temperature drops to reduce the amount of frost formed at the time of starting the defrosting operation, so that the amount of heat transferred from the refrigerant for defrosting becomes constant. The mentioned arrangement makes the resistance of the first expansion device 10 to be constant, thereby allowing inexpensive capillary tubes to be employed.

The controller 90 may have a threshold of the outdoor temperature, to perform the heating and defrosting operation when the outdoor temperature exceeds a certain level (e.g., −5 degrees Celsius or −10 degrees Celsius), and to suspend the heating operation of the indoor unit to defrost the entirety of the heat exchangers when the outdoor temperature is equal to or lower than the certain level. When the outdoor temperature is as low as equal to or lower than 0 degrees Celsius, for example −5 degrees Celsius or −10 degrees Celsius, basically the absolute humidity of the outdoor air is low and hence frost is barely formed, and consequently the duration of the normal operation before the amount of frost reaches a predetermined level is extended. Even when the heating operation of the indoor unit is suspended to defrost the entirety of the heat exchangers, the ratio of the time during which the heating operation of the indoor unit is suspended is low. When the heating and defrosting operation is performed, adding the option of defrosting the entirety of the heat exchangers improves the defrosting efficiency, when the heat radiation to the outdoor air from the outdoor heat exchanger to be defrosted is taken into account.

In the case where, as in Embodiment 1, the parallel heat exchangers 5-1 and 5-2 and the interface heat exchanger 11 are integrally built and the outdoor air is supplied to the parallel heat exchanger to be defrosted from the outdoor fan 5*f*, the fan output may be changed depending on the outdoor temperature, to reduce the heat radiation during the heating and defrosting operation.

Further, in the case where, as in Embodiment 1, the parallel heat exchangers 5-1 and 5-2 and the interface heat exchanger 11 are integrally built and connected via the fins 5*b*, a mechanism for reducing heat leakage (e.g., forming a notch or slit in the fin) may be provided, either or both of an area between the parallel heat exchanger 5-1 and the interface heat exchanger 11 and an area between the parallel heat exchanger 5-2 and the interface heat exchanger 11.

In this case, the defrosting effect in the boundary can be improved even when the number of heat transfer pipes incorporated in the interface heat exchanger 11 is decreased, compared with the case where the mechanism for reducing heat leakage is not provided. Decreasing the number of heat transfer pipes in the interface heat exchanger 11 and increasing the number of heat transfer pipes in either or both of the parallel heat exchangers 5-1 and 5-2 increase surface area of the parallel heat exchangers 5-1 and 5-2, thereby improving the heat removal performance when the parallel heat exchanger 5-1 or 5-2 acts as evaporator. As result, the heating capacity can be improved.

Embodiment 2

Figure 11:
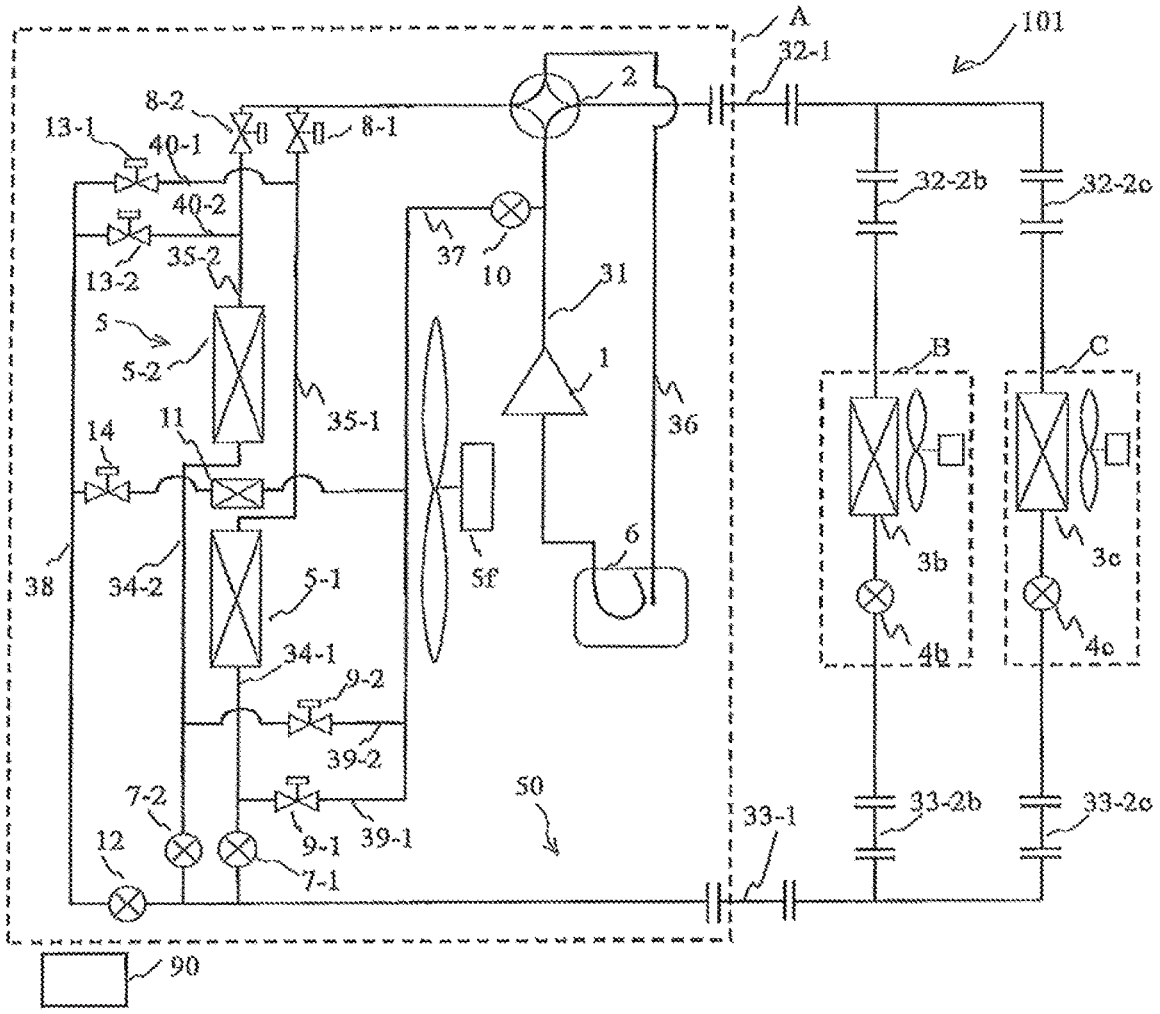
FIG. 11 is a schematic diagram showing a circuit configuration of an air-conditioning apparatus according to Embodiment 2 of the present invention.

FIG. 11 is a schematic diagram showing a circuit configuration of an air-conditioning apparatus 101 according to Embodiment 2 of the present invention.

The air-conditioning apparatus 101 will be described below focusing on differences from Embodiment 1.

In the air-conditioning apparatus 101 according to Embodiment 2, the first defrost pipes 39-1 and 39-2 are respectively connected to the first connection pipes 34-1 and 34-2, unlike in the air-conditioning apparatus 100 according to Embodiment 1.

Further, the air-conditioning apparatus 101 includes a second defrost pipe 40-1 connecting the second connection pipe 35-1 and the second bypass pipe 38 and a second defrost pipe 40-2 connecting the second connection pipe 35-2 and the second bypass pipe 38, in addition to the configuration of the air-conditioning apparatus 100 according to Embodiment 1.

The second defrost pipes 40-1 and 40-2 respectively include third solenoid valves 13-1 and 13-2, and the second bypass pipe 38 includes a fourth solenoid valve 14.

The solenoid valves 13-1, 13-2, and 14 are capable of switching the flow path, and hence may each be constituted of a four-way valve, a three-way valve, a two-way valve, or a similar device.

The second defrost pipes 40-1 and 40-2 according to Embodiment 2 each correspond to the third bypass pipe in the present invention. The fourth solenoid valve 14 corresponds to the first opening and closing device in the present invention. The first expansion device 10 and the third solenoid valve each correspond to the connection switching device in the present invention.

The cooling operation according to Embodiment 2 is different from Embodiment 1 in the following aspects.

The controller 90 closes the second expansion device 12, and opens the third solenoid valves 13-1 and 13-2 and the fourth solenoid valve 14.

The refrigerant passing through the first solenoid valve 8-1 is branched into two flows, one of which flows into the parallel heat exchanger 5-1 through the second connection pipe 35-1, and the other of which flows into the third solenoid valve 13-1 through the second defrost pipe 40-1. The refrigerant passing through the first solenoid valve 8-2 is branched into two flows, one of which flows into the parallel heat exchanger 5-2 through the second connection pipe 35-2, and the other of which flows into the third solenoid valve 13-2 through the second defrost pipe 40-2.

The refrigerant passing through the third solenoid valves 13-1 and 13-2 is merged and passes through the fourth solenoid valve 14, and then flows into the interface heat exchanger 11. The refrigerant flowing out of the interface heat exchanger 11 is branched into two flows, one of which flows into the first connection pipe 34-1 through the second solenoid valve 9-1, and the other of which flows into the first connection pipe 34-2 through the second solenoid valve 9-2.

In the case where, for example, the indoor units B and C have low operation capacity, one of the first solenoid valves 8-1 and 8-2 and the third solenoid valves 13-1 and 13-2 may be closed to prevent the refrigerant from flowing through one of the parallel heat exchangers 5-1 and 5-2, and the interface heat exchanger 11. Such an arrangement resultantly reduces the heat transfer area of the outdoor heat exchangers 5, thereby stabilizing the operation of the refrigeration cycle.

Alternatively, one of the third solenoid valves 13-1 and 13-2 may be closed to cause the refrigerant to flow only through the opened valve and then flow into the interface heat exchanger 11, and one of the second solenoid valves 9-1 and 9-2 may be closed to cause the refrigerant to flow only through the opened valve and the refrigerant flowing out of the interface heat exchanger 11 flows into only one of the first connection pipes 34-1 and 34-2.

The normal heating operation according to Embodiment 2 is different from Embodiment 1 in the following aspects.

The controller 90 closes the second expansion device 12, and opens the third solenoid valves 13-1 and 13-2 and the fourth solenoid valve 14.

The refrigerant flowing out of the first flow control devices 4*b* and 4*c* returns to the outdoor unit A through the second extension pipes 33-2*b*, 33-2*c*, and 33-1, and flows into the first connection pipes 34-1 and 34-2. The refrigerant flowing into the first connection pipe 34-1 passes through the second flow control device 7-1 and is branched into two flows, one of which flows into the parallel heat exchanger 5-1 and the other of which flows into the second solenoid valve 9-1 through the first defrost pipe 39-1. The refrigerant flowing into the first connection pipe 34-2 passes through the second flow control device 7-2 and is branched into two flows, one of which flows into the parallel heat exchanger 5-2 and the other of which flows into the second solenoid valve 9-2 through the first defrost pipe 39-2.

The refrigerant passing through the second solenoid valves 9-1 and 9-2 is merged and flows into the interface heat exchanger 11. The refrigerant flowing out of the interface heat exchanger 11 passes through the fourth solenoid valve 14 and is branched into two flows, one of which flows into the second connection pipe 35-1 through the third solenoid valve 13-1 and the other of which flows into the second connection pipe 35-2 through the third solenoid valve 13-2.

One of the second solenoid valves 9-1 and 9-2 may be closed to cause the refrigerant to flow only through the opened valve and flow into the interface heat exchanger 11, and one of the third solenoid valves 13-1 and 13-2 may be closed to cause the refrigerant to flow only through the opened valve and the refrigerant flowing out of the interface heat exchanger 11 flows into only one of the second connection pipes 35-1 and 35-2.

The heating and defrosting operation according to Embodiment 2 is different from Embodiment 1 in the following aspects.

The operation performed for defrosting the parallel heat exchanger 5-2 and causing the parallel heat exchanger 5-1 to act as evaporator to continue the heating operation will be described below. The operation for defrosting the parallel heat exchanger 5-1 and causing the parallel heat exchanger 5-2 to act as evaporator to continue the heating operation can be similarly performed, except that the open and closed states of the solenoid valves 8-1, 8-2, 9-1, 9-2, 13-1, and 13-2, and the flow control devices 7-1 and 7-2 are inverted, and that the flows of the refrigerant through the parallel heat exchanger 5-1 and the parallel heat exchanger 5-2 are switched.

Figure 12:
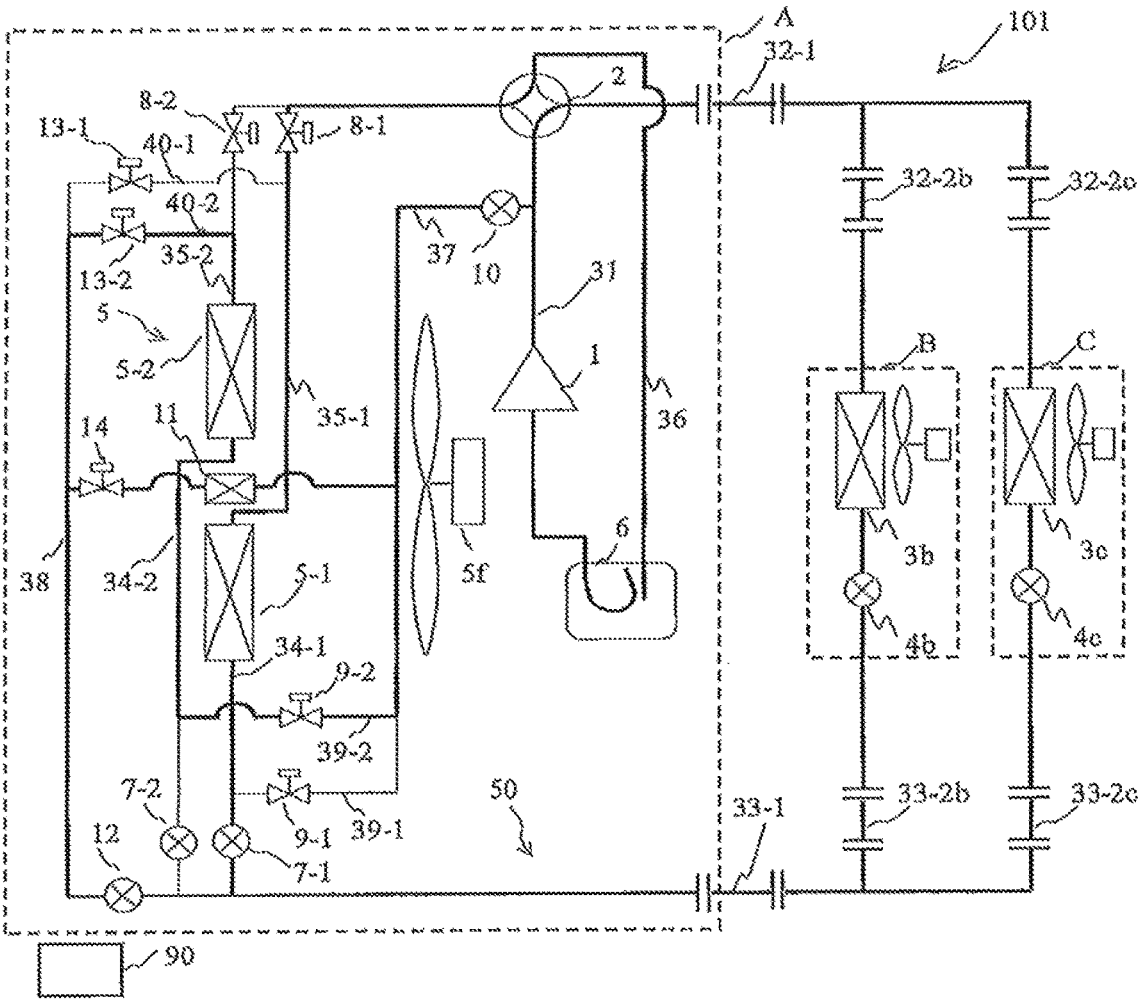
FIG. 12 is a schematic diagram showing a flow of refrigerant in a heating and defrosting operation performed for defrosting a parallel heat exchanger of the air-conditioning apparatus according to Embodiment 2 of the present invention.

FIG. 12 is a schematic diagram showing a flow of the refrigerant in the heating and defrosting operation for defrosting the parallel heat exchanger 5-2 of the air-conditioning apparatus 101 according to Embodiment 2 of the present invention. In FIG. 12, bold lines represent the portions where the refrigerant flows, and fine lines represent the portions where the refrigerant does not flow, in the heating and defrosting operation.

The controller 90 closes the first solenoid valve 8-2 and the second flow control device 7-2 corresponding to the parallel heat exchanger 5-2 to be defrosted. The controller 90 also opens the second solenoid valve 9-2, the third solenoid valve 13-2, and the fourth solenoid valve 14, and sets the first expansion device 10 to a predetermined opening degree. The first solenoid valve 8-1 corresponding to the parallel heat exchanger 5-1 acting as evaporator is caused to be opened, and the second solenoid valve 9-1 and the third solenoid valve 13-1 are caused to be closed.

Under such settings, the defrosting circuit sequentially connecting the compressor 1, the first expansion device 10, the second solenoid valve 9-2, the parallel heat exchanger 5-2, the third solenoid valve 13-2, and the second expansion device 12 is opened to start the heating and defrosting operation. In addition, the bypass circuit sequentially connecting the compressor 1, the first expansion device 10, the interface heat exchanger 11, the fourth solenoid valve 14, and the second expansion device 12 is opened to enhance the defrosting effect in the boundary, thereby preventing formation of root ice.

When the heating and defrosting operation is started, a part of the refrigerant discharged from the compressor 1 flows into the first bypass pipe 37, passes through the first expansion device 10, and is branched into two flows, one of which flows into the parallel heat exchanger 5-2 through the second solenoid valve 9-2, and the other of which flows into the interface heat exchanger 11. The refrigerant flowing out of the parallel heat exchanger 5-2 flows into the third solenoid valve 13-2 through the second defrost pipe 40-2. The refrigerant flowing out of the interface heat exchanger 11 flows into the fourth solenoid valve 14 through the second bypass pipe 38. The refrigerant passing through the third solenoid valve 13-2 and the fourth solenoid valve 14 is merged and passes through the second expansion device 12, and then reaches the main circuit 50 to be merged.

During the heating and defrosting operation, the controller 90 controls the opening degree of the second expansion device 12 to make the saturation temperature converted from the pressure of the parallel heat exchanger 5-2 and the interface heat exchanger 11 to be approximately 0 degrees Celsius to 10 degrees Celsius.

When the flow of the refrigerant through the bypass circuit sequentially connecting the compressor 1, the first expansion device 10, the interface heat exchanger 11, the fourth solenoid valve 14, and the second expansion device 12 is to be blocked, the controller 90 closes the fourth solenoid valve 14.

Figure 13:
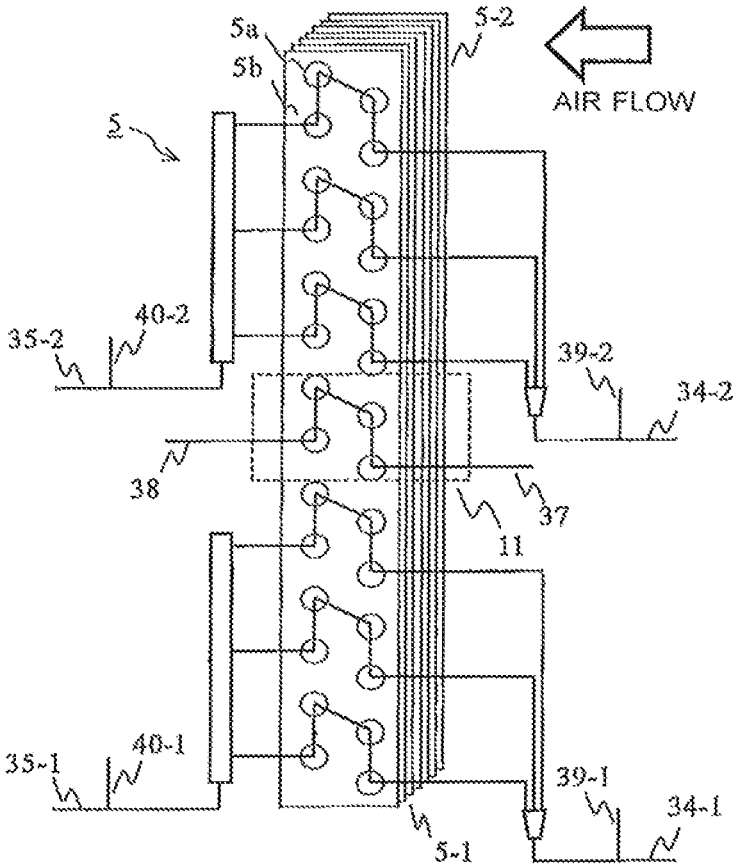
FIG. 13 is a schematic diagram showing a structure of an outdoor heat exchanger in the air-conditioning apparatus according to Embodiment 2 of the present invention.

FIG. 13 is a schematic diagram showing a structure of the outdoor heat exchanger 5 in the air-conditioning apparatus 101 according to Embodiment 2.

As shown in FIG. 13, the first connection pipes 34-1 and 34-2 and the first bypass pipe 37 are connected to the heat transfer pipes 5*a* on the upstream side of the parallel heat exchangers 5-1 and 5-2 and the interface heat exchanger 11 in the airflow direction. The heat transfer pipes 5*a* of the parallel heat exchangers 5-1 and 5-2 and the interface heat exchanger 11 are aligned in a plurality of columns in the airflow direction, so that the refrigerant sequentially flows to the downstream columns.

Consequently, in the cooling operation and the normal heating operation, the refrigerant can be made to flow in the same direction through each of the parallel heat exchangers 5-1 and 5-2 and the interface heat exchanger 11. Further, in the heating and defrosting operation, the refrigerant supplied to the parallel heat exchanger 5-1 or the parallel heat exchanger 5-2 to be defrosted and the interface heat exchanger 11 flows from the heat transfer pipes 5*a* on the upstream side in the airflow direction toward the heat transfer pipes 5*a* on the downstream side, and consequently the flow direction of the refrigerant and the airflow direction can be the same.

As described above, according to Embodiment 2, the refrigerant can be made to flow in the same direction through each of the parallel heat exchangers 5-1 and 5-2 and the interface heat exchanger 11, during the cooling operation and the heating operation. Consequently, heat can be efficiently exchanged with air. During the heating and defrosting operation, the flow direction of the refrigerant and the airflow direction can be the same, in the heat exchanger 5-1 or the parallel heat exchanger 5-2 to be defrosted and the interface heat exchanger 11. Consequently, the heat radiated to the air in the defrosting operation can be utilized to remove the frost stuck to the fins 5*b* on the downstream side, and thus the defrosting efficiency can be improved.

Although Embodiments 1 and 2 represent the case where the outdoor heat exchanger 5 is divided into the two parallel heat exchangers 5-1 and 5-2 and the interface heat exchanger 11, the present invention is not limited to such a configuration. The scope of the present invention is equally applicable to a configuration including three or more parallel heat exchangers and the interface heat exchangers each located in the boundary between the parallel heat exchangers next to each other, to defrost a part of the parallel heat exchangers and continue the heating operation with the remaining parallel heat exchangers.

Further, although the air-conditioning apparatus 100 according to Embodiment 1 and the air-conditioning apparatus 101 according to Embodiment 2 are configured to switch the cooling operation and the heating operation, the present invention is not limited to such a configuration. The present invention is also applicable to an air-conditioning apparatus having a circuit configuration that enables the cooling and heating mixed operation. Alternatively, the cooling-heating switching device 2 may be omitted, so that only the normal heating operation and the heating and defrosting operation can be performed.

REFERENCE SIGNS LIST

1: compressor, 2: cooling-heating switching device, 3*b*, 3*c*: indoor heat exchanger, 4*b*, 4*c*: first flow control device, 5: outdoor heat exchanger, 5-1, 5-2: parallel heat exchanger, 5*a*: heat transfer pipe, 5*b*: fin, 5*f*: outdoor fan, 6: accumulator, 7-1, 7-2: second flow control device, 8-1, 8-2: first solenoid valve, 9-1, 9-2: second solenoid valve, 10: first expansion device, 11: interface heat exchanger, 12: second expansion device, 13-1, 13-2: third solenoid valve, 14: fourth solenoid valve, 31: discharge pipe, 32-1, 32-2*b*, 32-2*c*: first extension pipe, 33-1, 33-2*b*, 33-2*c*: second extension pipe, 34-1, 34-2: first connection pipe, 35-1, 35-2: second connection pipe, 36: suction pipe, 37: first bypass pipe, 38: second bypass pipe, 39-1, 39-2: first defrost pipe, 40-1, 40-2: second defrost pipe, 50: main circuit, 90: controller, 100, 101: air-conditioning apparatus, A: outdoor unit, B, C: indoor unit

The invention claimed is:

1. An air-conditioning apparatus comprising:

a main circuit sequentially connecting, via a plurality of pipes, a compressor, an indoor heat exchanger, a first flow control device, and a plurality of parallel outdoor heat exchangers connected in parallel to each other to allow refrigerant to circulate;

a defrost pipe branching a part of the refrigerant discharged from the compressor and causing the part of the refrigerant branched by the defrost pipe to flow into one of the plurality of parallel outdoor heat exchangers;

an interface heat exchanger located between the plurality of parallel outdoor heat exchangers;

a first bypass pipe branching a part of the refrigerant discharged from the compressor and causing the part of the refrigerant branched by the first bypass pipe to flow into the interface heat exchanger;

a second bypass pipe causing the part of the refrigerant flowing out of the interface heat exchanger to flow into the main circuit; and one or both of a first expansion device configured to depressurize the refrigerant discharged from the compressor and flowing into the interface heat exchanger, and a second expansion device configured to depressurize the refrigerant flowing out of the interface heat exchanger, wherein the plurality of parallel outdoor heat exchangers includes only a first and a second outdoor heat exchanger parallel to each other.

2. An air-conditioning apparatus comprising:

a main circuit sequentially connecting, via a plurality of pipes, a compressor, an indoor heat exchanger, a first flow control device, and a plurality of parallel outdoor heat exchangers connected in parallel to each other to allow refrigerant to circulate;

a defrost pipe branching a part of the refrigerant discharged from the compressor and causing the part of the refrigerant branched by the defrost pipe to flow into one of the plurality of parallel outdoor heat exchangers;

an interface heat exchanger located between the plurality of parallel outdoor heat exchangers;

a first bypass pipe branching a part of the refrigerant discharged from the compressor and causing the part of the refrigerant branched by the first bypass pipe to flow into the interface heat exchanger; and a second bypass pipe allowing the refrigerant flowing out of the interface heat exchanger to flow into the main circuit on an upstream side of one of the plurality of parallel outdoor heat exchangers not to be defrosted, wherein the plurality of parallel outdoor heat exchangers includes only a first and a second outdoor heat exchanger parallel to each other.

3. The air-conditioning apparatus of claim 1, further comprising:

a first defrost pipe and a second defrost pipe; and a connection switching device configured to open and close a flow path respectively through each of the first bypass pipe, the first defrost pipe, and the second defrost pipe, and switches between a flow path through which the refrigerant flows to the first bypass pipe and the interface heat exchanger and a flow path through which the refrigerant flows to the first defrost pipe and the second defrost pipe and the interface heat exchanger, wherein the plurality of pipes includes at least a first connection pipe and a second connection pipe, each of the first connection pipe and the second connection pipe being a pipe to which the second bypass pipe is not connected, wherein the first defrost pipe has a first end connected to the first bypass pipe, and the second defrost pipe has a first end connected to the first bypass pipe, wherein the first defrost pipe has a second end connected to the first connection pipe, and the second defrost pipe has a second end connected to the second connection pipe, and wherein the first and second connection pipes are located on one of an upstream side and a downstream side of one of the plurality of parallel outdoor heat exchangers used as evaporator.

4. The air-conditioning apparatus of claim 3, wherein the connection switching device is controlled to close the flow path in the first bypass pipe, to allow the refrigerant to flow through the first defrost pipe, the second defrost pipe and the interface heat exchanger, during a heating operation in which all of the plurality of parallel outdoor heat exchangers each act as evaporator.

5. The air-conditioning apparatus of claim 3, wherein the connection switching device is controlled to close the flow path in the first bypass pipe, to allow the refrigerant to flow through the first defrost pipe, the second defrost pipe and the interface heat exchanger, during a cooling operation in which all of the plurality of parallel outdoor heat exchangers each act as condenser.

6. The air-conditioning apparatus of claim 1, wherein the second expansion device is controlled to set a pressure of the refrigerant flowing out of the interface heat exchanger to a medium pressure, during an operation for defrosting a part of the plurality of parallel outdoor heat exchangers.

7. The air-conditioning apparatus of claim 1, wherein the first expansion device is controlled to adjust a flow rate of the refrigerant flowing into the interface heat exchanger depending on an outdoor temperature, during an operation for defrosting a part of the plurality of parallel heat exchangers.

8. The air-conditioning apparatus of claim 2, further comprising a first opening and closing device provided in one of the first bypass pipe and the second bypass pipe, and configured to open and close a flow path through which the refrigerant flows from the first bypass pipe to the second bypass pipe through the interface heat exchanger, during an operation for defrosting a part of the plurality of parallel outdoor heat exchangers.

9. The air-conditioning apparatus of claim 8, having a threshold of an outdoor temperature during the operation for defrosting a part of the plurality of parallel outdoor heat exchangers, wherein the first opening and closing device is controlled to open the flow path when the outdoor temperature is equal to or lower than the threshold, and close the flow path when the outdoor temperature exceeds the threshold.

10. The air-conditioning apparatus of claim 8, wherein the first opening and closing device is controlled to open the flow path during an operation for defrosting one of the plurality of parallel outdoor heat exchangers on an upper side of the interface heat exchanger, and close the flow path during an operation for defrosting one of the plurality of parallel outdoor heat exchangers on a lower side of the interface heat exchanger.

11. The air-conditioning apparatus of claim 1, wherein, during an operation for defrosting a part of the plurality of parallel outdoor heat exchangers, the first bypass pipe branches a part of the refrigerant discharged from the compressor and causes the part of the refrigerant branched by the bypass pipe to flow into the interface heat exchanger, and the second bypass pipe causes refrigerant flowing out of the interface heat exchanger to flow into the main circuit, irrespective of which one of the plurality of parallel outdoor heat exchangers is to be defrosted.

12. The air-conditioning apparatus of claim 1, wherein, during an operation for defrosting a part of the plurality of parallel outdoor heat exchangers, one of the plurality of parallel outdoor heat exchangers located on an upper side is defrosted, after one of the plurality of parallel outdoor heat exchangers located on a lower side is defrosted.

13. The air-conditioning apparatus of claim 12, wherein, during the operation for defrosting a part of the plurality of parallel outdoor heat exchangers, the first bypass pipe branches a part of the refrigerant discharged from the compressor and causes the part of the refrigerant branched by the first bypass pipe to flow into the interface heat exchanger, and the second bypass pipe causes refrigerant flowing out of the interface heat exchanger to flow into the main circuit.

14. The air-conditioning apparatus of claim 12, wherein the plurality of parallel outdoor heat exchangers are arranged so that a value calculated by an expression of (flow rate of air applied to parallel heat exchanger at maximum fan speed (m3/s))×(surface area of parallel heat exchanger (m3)) in the one of the plurality of outdoor parallel heat exchangers on the upper side is larger than a value calculated by the expression of (flow rate of air applied to parallel heat exchanger at maximum fan speed (m3/s))×(surface area of parallel heat exchanger (m3)) in the one of the plurality of parallel outdoor heat exchangers on the lower side.

* * * * *